US010315242B2

(12) United States Patent
Kaanta et al.

(10) Patent No.: US 10,315,242 B2
(45) Date of Patent: Jun. 11, 2019

(54) APPARATUS AND METHOD FOR SIMULTANEOUSLY FORMING A CONTOURED SHOULDER AND NECK PORTION IN A CLOSED END OF A METALLIC CONTAINER

(71) Applicant: Ball Metalpack, LLC, Westminster, CO (US)

(72) Inventors: Jason Kaanta, Pine, CO (US); Daniel A. Edwards, Thornton, CO (US)

(73) Assignee: Ball Metalpack, LLC, Broomfield, CO (US)

( * ) Notice: Subject to any disclaimer, the term of this patent is extended or adjusted under 35 U.S.C. 154(b) by 737 days.

(21) Appl. No.: 14/884,024

(22) Filed: Oct. 15, 2015

(65) Prior Publication Data

US 2016/0107219 A1 Apr. 21, 2016

Related U.S. Application Data

(60) Provisional application No. 62/064,115, filed on Oct. 15, 2014.

(51) Int. Cl.

| | |
|---|---|
| ***B65D 1/02*** | (2006.01) |
| ***B21D 51/24*** | (2006.01) |
| ***B21D 51/26*** | (2006.01) |

(52) U.S. Cl.

CPC ..... *B21D 51/26* (2013.01); *B21D 51/2638* (2013.01); *B21D 51/24* (2013.01); *B65D 1/023* (2013.01)

(58) Field of Classification Search

CPC .... B21D 51/26; B21D 51/2638; B21D 22/28; B21D 24/005; B21D 22/30

USPC ..... 413/70; 72/349

See application file for complete search history.

(56) References Cited

U.S. PATENT DOCUMENTS

| | | | | |
|---|---|---|---|---|
| 242,472 | A | 6/1881 | Newton | |
| 452,713 | A | 5/1891 | Lewis | |
| 1,698,990 | A | 1/1929 | Hothersall | |
| 2,189,004 | A | 2/1940 | Harwood | |
| 2,337,182 | A | 12/1943 | Calleson et al. | |
| 2,339,763 | A | 1/1944 | Calleson et al. | |
| 2,359,775 | A * | 10/1944 | McManus ..... | B21D 51/26 72/47 |
| 2,426,550 | A | 8/1947 | Coyle | |

(Continued)

FOREIGN PATENT DOCUMENTS

| | | |
|---|---|---|
| AU | 2012244852 | 10/2012 |
| CA | 2348438 | 3/2001 |

(Continued)

OTHER PUBLICATIONS

International Preliminary Report on Patentability for International (PCT) Patent Application No. PCT/US2015/055715, dated Apr. 27, 2017 12 pages.

(Continued)

*Primary Examiner* — Gregory D Swiatocha
(74) *Attorney, Agent, or Firm* — Brown Rudnick LLP

(57) ABSTRACT

An apparatus and method of simultaneously forming a contoured shoulder and neck portion on a closed end a metallic container are provided. More specifically, an apparatus and methods of forming a contoured shoulder and neck portion on a closed end of a metallic two-piece container are disclosed.

21 Claims, 21 Drawing Sheets

(56) References Cited

U.S. PATENT DOCUMENTS

D195,103 S 4/1963 Houghton
D198,342 S 6/1964 Taylor et al.
D200,362 S 2/1965 Nelson et al.
D209,480 S 12/1967 Wallace
3,494,169 A 2/1970 Saunders
3,508,427 A 4/1970 Broderick
D217,585 S 5/1970 Lambelet
D217,847 S 6/1970 Jenkins et al.
3,690,507 A 9/1972 Gailus et al.
D225,210 S 11/1972 Becker
D225,835 S 1/1973 Johnson et al.
D226,370 S 2/1973 Cromb
1,372,624 A 4/1973 Arangelovich et al.
3,726,244 A * 4/1973 Arangelovich ..... B21D 28/32 72/348
3,733,881 A 5/1973 Grigorenko
3,738,540 A 6/1973 Morane
D228,625 S 10/1973 Pearce
3,786,957 A 1/1974 Hilgenbrink
D232,915 S 9/1974 Becker
3,964,413 A 6/1976 Saunders
3,972,217 A 8/1976 Misonoo
3,995,572 A 12/1976 Saunders
4,095,544 A 6/1978 Peters et al.
4,116,361 A 9/1978 Stargell
D256,776 S 9/1980 Monnet
4,261,193 A * 4/1981 Boik ..... B21D 41/04 72/349
4,281,769 A 8/1981 Ignell
4,386,514 A 6/1983 Herten
4,416,388 A 11/1983 Mulawski
4,433,791 A 2/1984 Mulawski
4,442,692 A 4/1984 Lyu
4,485,863 A 12/1984 Gold et al.
4,513,874 A 4/1985 Mulawski
4,527,412 A * 7/1985 Stoffel ..... B21D 51/2615 493/1
4,571,978 A 2/1986 Taube et al.
4,580,690 A 4/1986 Mulawski
4,734,303 A 3/1988 Fujiwara et al.
4,753,364 A 6/1988 Stoffel et al.
4,774,839 A 10/1988 Caleffi et al.
4,796,454 A 1/1989 Bulso, Jr. et al.
4,863,333 A 9/1989 Kaminski
D307,648 S 5/1990 Arrington
4,962,659 A 10/1990 Imazu et al.
4,984,708 A 1/1991 Imazu et al.
5,014,536 A 5/1991 Saunders
5,024,077 A 6/1991 Bulso, Jr. et al.
D325,697 S 4/1992 Parr
5,105,645 A 4/1992 Kobayashi et al.
5,111,679 A 5/1992 Kobayashi et al.
5,138,858 A 8/1992 Johnson et al.
5,168,742 A 12/1992 Heyes et al.
5,209,099 A 5/1993 Saunders
5,249,447 A 10/1993 Aizawa et al.
5,297,414 A 3/1994 Sainz
5,343,729 A 9/1994 Saunders
5,347,839 A 9/1994 Saunders
5,355,710 A 10/1994 Dickhoff
D352,004 S 11/1994 Bikoff et al.
5,388,716 A 2/1995 Stoffel et al.
5,394,727 A 3/1995 Diekhoff et al.
5,409,130 A 4/1995 Saunders
5,433,099 A 7/1995 Katsuhiro et al.
5,487,295 A 1/1996 Diekhoff et al.
5,497,900 A 3/1996 Caleffi et al.
D369,294 S 4/1996 Hirato
5,522,248 A 6/1996 Diekhoff et al.
5,544,517 A 8/1996 Shimizu
5,555,992 A 9/1996 Sedgeley
5,557,963 A 9/1996 Diekhoff
5,572,893 A 11/1996 Goda et al.
D378,016 S 2/1997 Armbruster et al.
5,622,070 A 4/1997 Bulso, Jr.
D381,575 S 7/1997 Mahlmann
5,647,242 A 7/1997 Saunders
D381,913 S 8/1997 Abfier et al.
5,653,357 A 8/1997 Miyazawa et al.
5,678,446 A 10/1997 Futamura et al.
5,689,992 A 11/1997 Saunders et al.
5,718,352 A 2/1998 Diekhoff et al.
5,750,223 A 5/1998 Tada et al.
5,782,375 A 7/1998 McHenry et al.
5,822,843 A 10/1998 Diekhoff et al.
D406,062 S 2/1999 Brewer
5,972,402 A 10/1999 Scholl et al.
6,010,026 A 1/2000 Diekhoff et al.
6,010,028 A 1/2000 Jordan et al.
6,032,505 A 3/2000 Stodd
6,095,378 A 8/2000 Potts et al.
6,102,305 A 8/2000 Chapman et al.
6,182,487 B1 2/2001 Komiya et al.
D443,520 S 6/2001 Patricola
6,244,091 B1 6/2001 McClung et al.
6,305,210 B1 10/2001 Saunders et al.
D453,003 S 1/2002 Rashid
6,463,776 B1 10/2002 Enoki et al.
6,499,329 B1 12/2002 Enoki et al.
6,585,411 B2 7/2003 Hammarth et al.
D481,938 S 11/2003 McRae
D489,987 S 5/2004 Ogata et al.
D489,988 S 5/2004 Ogata et al.
D492,599 S 7/2004 Enoki et al.
6,837,089 B2 1/2005 Jentzsch
6,857,304 B2 2/2005 Enoki
7,191,632 B2 3/2007 Kanehara et al.
7,222,757 B2 5/2007 Ferreira et al.
7,337,646 B2 3/2008 Aoyagi et al.
7,354,234 B2 4/2008 Fujishige et al.
7,497,350 B2 3/2009 Enoki et al.
7,621,166 B2 11/2009 Ferreira et al.
7,654,124 B2 2/2010 Knaup
7,721,578 B2 5/2010 Enoki et al.
7,878,040 B2 2/2011 Taya et al.
8,439,222 B2 5/2013 McClung et al.
8,713,980 B2 5/2014 Fleischer et al.
9,174,262 B2 11/2015 Monro et al.
9,327,333 B2 5/2016 Blue
9,327,899 B2 5/2016 Greenfield et al.
9,328,625 B2 5/2016 Blue
9,334,078 B2 5/2016 Riley et al.
9,387,530 B2 7/2016 Fowler et al.
2003/0046971 A1* 3/2003 Enoki ..... B21D 22/30 72/348
2004/0173560 A1* 9/2004 Chupak ..... B21D 22/28 215/40
2006/0277957 A1* 12/2006 Fujishige ..... B21D 51/26 72/46
2009/0223956 A1 9/2009 Matsukawa et al.
2010/0176224 A1 7/2010 Hasselschwert et al.
2010/0242567 A1 9/2010 Nardini et al.
2012/0043294 A1* 2/2012 Dick ..... B21D 51/2615 215/40
2013/0098926 A1 4/2013 Monro et al.
2014/0161566 A1 6/2014 Presset et al.
2014/0298878 A1 10/2014 Van De Liefvoort
2015/0047407 A1 2/2015 Monro et al.
2015/0283597 A1 10/2015 Monro
2016/0114371 A1 4/2016 Lord et al.
2017/0050232 A1 2/2017 Schremmer et al.
2017/0095852 A1 4/2017 Carstens et al.
2017/0128999 A1 5/2017 Butcher et al.

FOREIGN PATENT DOCUMENTS

CA 2352747 4/2001
CN 101888907 11/2010
CN 102049446 5/2011
CN 102665957 9/2012
CN 103118817 5/2013
CN 103313807 9/2013
CN 103702780 4/2014

(56) References Cited

FOREIGN PATENT DOCUMENTS

| | | |
|---|---|---|
| CN | 104084486 | 10/2014 |
| CN | 106541014 | 3/2017 |
| CN | 304486417 | 2/2018 |
| EP | 0076634 | 4/1983 |
| EP | 0092253 | 10/1983 |
| EP | 326052 | 8/1989 |
| EP | 0404420 | 12/1990 |
| EP | 0412166 | 2/1991 |
| EP | 0457423 | 11/1991 |
| EP | 0505562 | 9/1992 |
| EP | 0536952 | 4/1993 |
| EP | 0667193 | 8/1995 |
| EP | 0684183 | 11/1995 |
| EP | 740971 | 11/1996 |
| EP | 743255 | 11/1996 |
| EP | 1134046 | 9/2001 |
| EP | 1136154 | 9/2001 |
| EP | 1153849 | 11/2001 |
| EP | 0721384 | 12/2002 |
| EP | 1448326 | 8/2004 |
| EP | 1673183 | 6/2006 |
| EP | 1787736 | 5/2007 |
| EP | 2531409 | 5/2016 |
| FR | 2495507 | 6/1982 |
| GB | 1259773 | 1/1972 |
| GB | 1345227 | 1/1974 |
| GB | 1349059 | 3/1974 |
| GB | 2547016 | 8/2017 |
| JP | S59115239 | 7/1984 |
| JP | S61176433 | 8/1986 |
| JP | S61206533 | 9/1986 |
| JP | H03221218 | 9/1991 |
| JP | H04351231 | 12/1992 |
| JP | H0826354 | 1/1996 |
| JP | H0939975 | 2/1997 |
| JP | H10272520 | 10/1998 |
| JP | S63295028 | 12/1998 |
| JP | H11722 | 1/1999 |
| JP | H11105845 | 4/1999 |
| JP | H11164784 | 6/1999 |
| JP | H11169980 | 6/1999 |
| JP | 2000/016416 | 1/2000 |
| JP | 2000/190042 | 7/2000 |
| JP | 2001/038828 | 2/2001 |
| JP | 2002/256366 | 9/2002 |
| RU | 1819173 | 5/1993 |
| WO | WO 95/15259 | 6/1995 |
| WO | WO 96/15865 | 5/1996 |
| WO | WO 98/20992 | 5/1998 |
| WO | WO 98/29206 | 7/1998 |
| WO | WO 01/15829 | 3/2001 |
| WO | WO 2007/052364 | 5/2007 |
| WO | WO 2009/071434 | 6/2009 |
| WO | WO 2011/049775 | 4/2011 |
| WO | WO 2011/053776 | 5/2011 |
| WO | WO 2011/095595 | 8/2011 |
| WO | WO 2011/095613 | 8/2011 |
| WO | WO 2011/128347 | 10/2011 |
| WO | WO 2011/128385 | 10/2011 |
| WO | WO 2013/017485 | 2/2013 |
| WO | Wo 2014/047115 | 3/2014 |
| WO | WO 2014/110387 | 7/2014 |
| WO | WO 2014/150673 | 9/2014 |
| WO | WO 2014/159215 | 10/2014 |
| WO | WO 2014/170476 | 10/2014 |
| WO | WO 2017/031450 | 2/2017 |
| WO | WO 2017/134413 | 8/2017 |
| WO | WO 2018/067249 | 4/2018 |

OTHER PUBLICATIONS

Official Action for Australia Patent Application No. 2015332413, dated Nov. 13, 2017 3 pages.

International Search Report and Written Opinion for International (PCT) Patent Application No. PCT/US15/55715, dated Dec. 31, 2015 13 pages.

International Search Report and Written Opinion for International (PCT) Patent Application No. PCT/US15/57799, dated May 17, 2016 9 pages.

U.S. Appl. No. 15/453,139, filed Mar. 8, 2017, Lord et al.

Official Action for Australia Patent Application No. 2015332413, dated Jun. 4, 2018 3 pages.

Official Action for Canada Patent Application No. 2,963,481, dated Mar. 22, 2018 5 pages.

Extended Search Report for European Patent Application No. 15850149.4, dated Apr. 20, 2018 5 pages.

* cited by examiner 60
66
15B
13A
62
14
20
68
64

62
46
66
63
14
44
61
6
60
15B
20
16
64

APPARATUS AND METHOD FOR SIMULTANEOUSLY FORMING A CONTOURED SHOULDER AND NECK PORTION IN A CLOSED END OF A METALLIC CONTAINER

CROSS-REFERENCE TO RELATED APPLICATIONS

This application claims priority under 35 U.S.C. § 119(e) to U.S. Provisional Patent Application Ser. No. 62/064,115 filed Oct. 15, 2014, which is incorporated herein in its entirety by reference.

FIELD OF THE INVENTION

The present invention relates generally to the manufacturing of metallic container bodies. More specifically, the present invention relates to methods and an apparatus for forming a contoured shoulder on a closed end portion of a metallic container.

BACKGROUND

Metallic containers offer distributors and consumers many benefits. The metallic body of a container provides optimal protection properties for products. For example, the metallic body prevents $CO_2$ migration and UV radiation which may damage personal care, pharmaceutical, and food products and other UV-sensitive formulations, negatively influencing the effectiveness of ingredients, as well as the fragrance, flavor, appearance, or color of the product. Metallic containers also offer an impermeable barrier to light, water vapor, oils and fats, oxygen, and micro-organisms and keep the contents of the container fresh and protected from external influences, thereby guaranteeing a long shelf-life.

Additionally, the increased durability of metallic containers compared to glass and plastic containers reduces the number of containers damaged during processing and shipping, resulting in further savings. Metallic containers are also lighter than glass containers resulting in energy savings during shipment. Further, metallic containers, such as aerosol containers, have significant durability and are difficult to deform or burst and thus are highly valuable for holding products under pressure. Finally, recycling metallic containers is easier than recycling glass and plastic containers because labels and other indicia are printed directly onto the metallic body while glass and plastic containers typically have labels that must be separated during the recycling process.

Methods of manufacturing metallic aerosol containers are known in the container industry and may include a process where a metallic cup is formed in a draw and wall ironing (DWI) process. The manufacture of the metallic cup in a DWI process requires a number of separate processing steps. The manufacture of the metallic container body typically starts by forming a cup from a metallic stock material which is typically shipped and stored in large coils. The coil of metallic material is fed into a blank-and-draw press which cuts a generally circular blank of a predetermined diameter from the coil and draws the blank into a smaller diameter cylinder one or more times to produce a formed cup. As appreciated by one skilled in the art, numerous varieties of blank, draw, and redraw steps may be performed to initially form a cylindrical shaped cup.

Alternatively, the metallic container body may be formed at least partially by an impact extrusion process. Impact extrusion is a process utilized to make metallic containers and other articles with unique shapes from metallic slugs. The slugs are typically made from a softened metal slug comprised of steel, magnesium, copper, aluminum, tin, and lead and other alloys. The metallic container body is formed inside a confining die from a cold slug which is contacted by a punch. The force from the punch deforms the metal slug around an outer diameter of the punch and the inner diameter of the confining die to make a formed cup.

The formed cup from the blank-and-draw press or the impact extrusion press is transferred to a second press where it is redrawn and ironed. An open end of the formed cup is then trimmed to a predetermined height forming a trimmed metallic container body. A shoulder and a neck portion with a reduced diameter are then formed in the closed end portion of the metallic container body in a number of successive operations.

Prior art methods of forming a shoulder and a neck portion on a metallic container body are described in U.S. Pat. No. 2,337,182 to Calleson et al. ("Calleson") and U.S. Pat. No. 3,726,244 to Arangelovich et al. ("Arangelovich") which are each incorporated herein by reference in their entireties. Calleson and Arangelovich utilize tools and methods for forming a shoulder and neck on the closed end of a container that are slow and utilize tools with linear, flat faces. Both patents also teach the use of a punch that contacts an interior portion of the closed end to form an opening therein before the formation of the shoulder and the neck are completed. Further, both Calleson and Arangelovich form a shoulder that is straight and does not provide an aesthetically pleasing, rounded shoulder.

Other methods of forming a shoulder and neck portion on a closed end of a metallic container body are described in U.S. Pat. Nos. 6,499,329 and 6,857,304 which are assigned to Daiwa Can Company and which are each incorporated herein by reference in their entireties. The shoulder of the metallic container is formed in a sequential process with forming steps sequentially using tools with linear, flat end portions. The shoulder is extended and smoothed between a pair of forming tools after the final neck diameter is formed to remove the wrinkling of the shoulder portion, while extending the overall length of the neck portion. The presses used in the methods described in these patents are generally difficult to service and calibrate due to the inaccessibility of the dozens of tooling stations and other components and excessive material wrinkling may occur during shoulder forming.

Accordingly, there is an unmet need for a high speed method and apparatus of forming a contoured shoulder and neck portion on a metallic container such as a two-piece aerosol container with an improved appearance, efficiency, and cost.

SUMMARY OF THE INVENTION

The present invention provides novel methods and apparatus for forming a contoured shoulder and neck portion on metallic container bodies, such as aerosol container bodies, in a cost effective, reliable manner. In one aspect of the present invention, an apparatus is provided for simultaneously forming a smooth contoured shoulder and neck portion without requiring a subsequent smoothing to eliminate irregularities in the shoulder portion of the metallic container body. In another aspect, after the neck portion has a final diameter, a selected portion of the contoured shoulder is reformed to change a radius between a lower end of the neck portion and an upper portion of the contoured shoulder.

In another aspect of the present invention, the apparatus is operable to perform metal drawing and forming on a closed end of a metallic container body at a rate of greater than 200 metallic container bodies per minute. In a more preferred embodiment, the apparatus is operable to perform metal drawing and forming on the closed end of more than 600 metallic container bodies per minute. It is another aspect of the present invention to provide an apparatus with tooling and components that are accessible, easier to service, adjust, and calibrate compared to known drawing presses.

In one embodiment of the present invention, the apparatus includes four rotary drawing presses. In another embodiment, each of the four rotary drawing presses includes a rotating turret with 10 cam-actuated rams. Each of the four rotary drawing presses includes a different set of tooling operably interconnected to each of the rams and to the turret.

It is one aspect of the present invention to provide a method for simultaneously forming a contoured shoulder and neck portion on a closed end of a metallic container body having a first shape. The method generally comprises, but is not limited to: (1) providing a draw die having an arcuate face portion adapted to be positioned proximate to an exterior closed end portion of the metallic container body; (2) providing a draw ring adapted to be positioned within an interior of the metallic container body and having an arcuate shaped face positioned in opposing relationship to the arcuate face of the draw die; (3) providing a second draw die having an arcuate face portion adapted to be positioned proximate to an exterior of a portion of a shoulder portion of the metallic container body; (4) providing a punch adapted to be positioned within the innermost portion of the metallic container body; (5) performing at least one forming operation with the punch, the draw die, and the draw ring on the closed end of the metallic container body to progressively form an arcuate shaped shoulder portion and a neck portion with a reduced diameter on the closed end of the metallic container body; and (6) performing a final forming operation to change a radius between the arcuate shaped shoulder portion and the neck portion of the metallic container body. In one embodiment, during the final forming operation, a pilot supports an interior surface of the neck portion while a clamping ring and the second draw die work in an opposing relationship to pinch the radius between the arcuate shoulder portion and the neck portion. The pilot does not contact an interior surface of the closed end of the metallic container body. The method may further comprise removing a portion of the neck portion to form an opening adapted to receive an end closure or dispensing apparatus.

In one embodiment, the method may further comprise providing one or more additional draw dies, draw rings, and punches. Additional forming operations may be performed by a complimentary movement between the one or more additional draw dies, additional draw rings, and additional punches to shape the geometry of the arcuate shaped shoulder portion and reduce a first diameter of the neck portion to a final diameter. The final diameter of the neck portion is smaller than the first diameter.

In another embodiment, the additional forming operations comprise a second forming operation and a third forming operation. The second forming operation is performed by a second draw die, a second draw ring, and a second punch to reduce the first diameter of the neck portion to a second diameter. The third forming operation is performed by a third draw die, a third draw ring, and a third punch to reduce the second diameter of the neck portion to the final diameter. Optionally, an exterior clamping ring and an interior clamping ring may be used during the third forming operation.

In one embodiment, a selected portion of the shoulder portion is reshaped during the final forming operation. The selected portion of the shoulder portion that is reshaped during the final forming operation is closer to the neck portion than to a sidewall portion of the metallic container body. In another embodiment, the arcuate face portion of the second draw die used in the final forming operation has a maximum internal diameter that is less than the maximum exterior diameter of the shoulder portion of the metallic container body.

In another embodiment, the reduced diameter of the neck portion is not altered during the final forming operation. Optionally, a height of the neck portion remains substantially constant during the final forming operation. In one embodiment, the height of the neck portion does not increase. In another embodiment, the height decreases. In still another embodiment, the height of the neck decreases by up to about 0.02 inches. In a more preferred embodiment, the neck height decreases by up to about 0.01 inches.

In another aspect of the present invention, a novel method of simultaneously forming a contoured shoulder and a reduced diameter neck on a closed end portion of a metallic container is provided. More specifically, the method generally comprises: (1) providing a metallic container comprising an open end, a closed end portion, and a sidewall portion extending therebetween; (2) providing a punch positioned to apply a force on an interior surface of the centermost portion of the closed end portion; (3) providing a draw ring positioned adjacent to the punch and having an arcuate shaped leading end; (4) providing a draw die positioned on an exterior surface of the closed end portion and having an arcuate shaped draw die face and an upper recess with a predetermined diameter which is smaller than the diameter of the closed end of the metallic container; (5) engaging the interior and exterior surfaces of the sidewall portion and the closed end portion of the metallic container with the draw ring and the draw die to provide a clamping force to simultaneously form a reduced diameter neck portion on the closed end portion and change the shape of a shoulder of the metallic container; (6) repeating, at least one more time, the engaging with the draw ring and the draw die to modify the shoulder of the metallic container while simultaneously reducing the diameter of the closed end portion at least one more time until the neck portion has a final external diameter; and (7) reducing a radius interconnecting the neck portion and the shoulder of the metallic container with a second draw die and a clamping ring to reshape a transition between the neck portion and the shoulder portion of the metallic container.

In one embodiment, the method further comprises utilizing a draw die with a different arcuate shaped draw die face and upper recess and a different draw ring to modify the shoulder of the metallic container while simultaneously reducing the diameter of the closed end portion. Optionally, in another embodiment, the method further comprises removing a portion of the neck portion to form an opening adapted to receive an end closure or dispensing apparatus or an end closure.

In another embodiment, reducing the radius may further comprise engaging a predetermined portion of the exterior surface of the shoulder portion with a draw die face of the second draw die. An interior surface of the shoulder may be engaged with a face of the clamping ring and an interior vertical surface of the neck portion is engaged by a pilot. In one embodiment, an axial end of the pilot does not contact the interior upper surface of the closed neck portion.

In one embodiment, reducing the radius between the neck portion and the shoulder portion does not change the height of the neck portion. In another embodiment, the height of the neck portion does not increase as the radius between the neck portion and the shoulder portion is changed. In another embodiment, the neck height may decrease by up to about 0.02 inches. In a more preferred embodiment, the neck height decreases by up to about 0.01 inches. In another embodiment, while reducing the radius between the neck portion and the shoulder portion, the interior upper surface of the closed neck portion of the metallic container does not contact any tools positioned within an interior of the metallic container.

It is another aspect of the present invention to provide a set of tools for shaping a metallic container body with a closed end and a shoulder portion by working the closed end to simultaneously form a contoured, arcuate shoulder portion and a neck portion with a reduced diameter. The tools generally include, but are not limited to: (1) a draw die having an inner face with an arcuate shape adapted to be brought into abutment against an outer surface of the shoulder portion; (2) a draw ring having an outer face with an arcuate shape adapted to be brought into abutment against an inner surface of the shoulder portion, the draw ring outer face and the draw die inner face having opposing shapes to provide a compressive force on the shoulder portion; (3) a form punch for contacting and applying a force to an inner face of the closed end at a portion closer to a center of the closed end than the shoulder portion, the form punch having a predetermined diameter to form the neck portion in the closed end of the metallic container body; (4) a pilot for supporting an inner vertical surface of the neck portion after the neck portion has been shaped a final time to a predetermined diameter; and (5) a clamping ring positioned axially adjacent to the pilot and having an outer face with an arcuate shape adapted to be brought into abutment against the inner surface of the shoulder portion. The clamping ring is adapted to support the shoulder portion when a portion of the shoulder portion is pinched between the draw die inner face and the clamping ring outer face to change a radius of curvature between the shoulder portion and the neck portion.

In one embodiment, the tools further comprise an exterior clamping ring having an inner face with an arcuate shape adapted to be brought into abutment against the outer surface of the shoulder portion. The exterior clamping ring is positioned radially outward of the draw die. In another embodiment, the tools further comprise an interior clamping ring having an outer face with an arcuate shape adapted to be brought into abutment against an inner surface of the shoulder portion. The interior clamping ring is positioned radially outward of the draw ring and the form punch. The exterior and interior clamping rings are adapted to support the shoulder portion as the draw die, draw ring, and form punch change the diameter of the neck portion the final time to the predetermined diameter.

In another embodiment, a leading end portion of the inner face of the draw die has a shape that is not identical to a shape of the outer face of the shoulder portion. A leading end portion of the outer face of the draw ring has a shape that is not identical to a shape of the inner face of the shoulder portion.

In still another embodiment, the clamping ring and the draw die modify an intersection of the neck portion and the shoulder portion without changing the predetermined diameter of the neck portion. In this manner, the radius of curvature between the shoulder portion and the neck portion is reduced and the height of the neck is maintained substantially unchanged. In one embodiment, the neck height does not increase. In another embodiment, the neck height decreases by up to about 0.02 inches. In a more preferred embodiment, the neck height decreases by up to about 0.01 inches. In one embodiment, when the intersection of the neck portion and the shoulder portion is modified, an axial end portion of the pilot does not come into contact with an inner upper surface of the closed end of the metallic container body. In another embodiment, the draw die that pinches the shoulder portion with the clamping ring comprises a second draw die with an arcuate inner face portion that has a maximum internal diameter that is less than the maximum external diameter of the shoulder portion of the metallic container body.

Optionally, in one embodiment of the present invention, the set of tools further comprises first, second, third, and fourth sets of tool. The first set of tools comprises a first draw die, a first draw ring, and a first form punch. The second set of tools comprises a second draw die, a second draw ring, and a second form punch. The third set of tools comprises a third draw die, an upper or exterior clamping ring, a third draw ring, a third form punch, and a lower or interior clamping ring. The fourth set of tools comprises a fourth draw die, a pilot, and a second lower or interior clamping ring.

In one embodiment, after forming the neck portion on the metallic container with the first set of tools, the metallic container has a height of between about 4 inches and about 11 inches. In a more preferred embodiment, the metallic container has a height of between about 6.3 inches and about 6.7 inches or between about 7.8 inches and about 8.2 inches. In yet another embodiment, when the closed end portion has the final external diameter, the metallic container has a height of between about 4 inches and about 12 inches. In another embodiment, the height of the metallic container is between about 7.206 inches and about 7.406 inches or between about 8.768 inches and about 8.968 inches.

The above-described embodiments, objectives, and configurations are neither complete nor exhaustive. As will be appreciated, other embodiments of the invention are possible using, alone or in combination, one or more of the features set forth above or described in detail below.

Although generally referred to herein as "aerosol containers," "metallic aerosol container bodies," and/or "metallic containers," it should be appreciated that the method and apparatus of embodiments of the current invention may be used to form any variety of containers or other articles of manufacture of any size or shape and for any type of product. Further, as will be appreciated by one of skill in the art, the method and apparatus of embodiments of the current invention may be used to form aerosol container bodies of any material, including aluminum, tin, steel, and combinations thereof.

The phrases "at least one," "one or more," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B and C together.

Unless otherwise indicated, all numbers expressing quantities, dimensions, conditions, and so forth used in the specification and claims are to be understood as being modified in all instances by the term "about."

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts and the equivalents thereof shall include all those described in the Summary of the Invention, Brief Description of the Drawings, Detailed Description, Abstract, and Claims themselves.

The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description and no limitation as to the scope of the present invention is intended by either the inclusion or non-inclusion of elements or components. Additional aspects of the present invention will become more readily apparent from the Detailed Description, particularly when taken together with the drawings.

BRIEF DESCRIPTION OF DRAWINGS

The accompanying drawings, which are incorporated herein and constitute a part of the specification, illustrate embodiments of the invention and together with the Summary of the Invention given above and the Detailed Description of the drawings given below serve to explain the principles of these embodiments. In certain instances, details that are not necessary for an understanding of the disclosure or that render other details difficult to perceive may have been omitted. It should be understood, of course, that the invention is not necessarily limited to the particular embodiments illustrated herein. Additionally, it should be understood that the drawings are not necessarily to scale.

Figure 1:
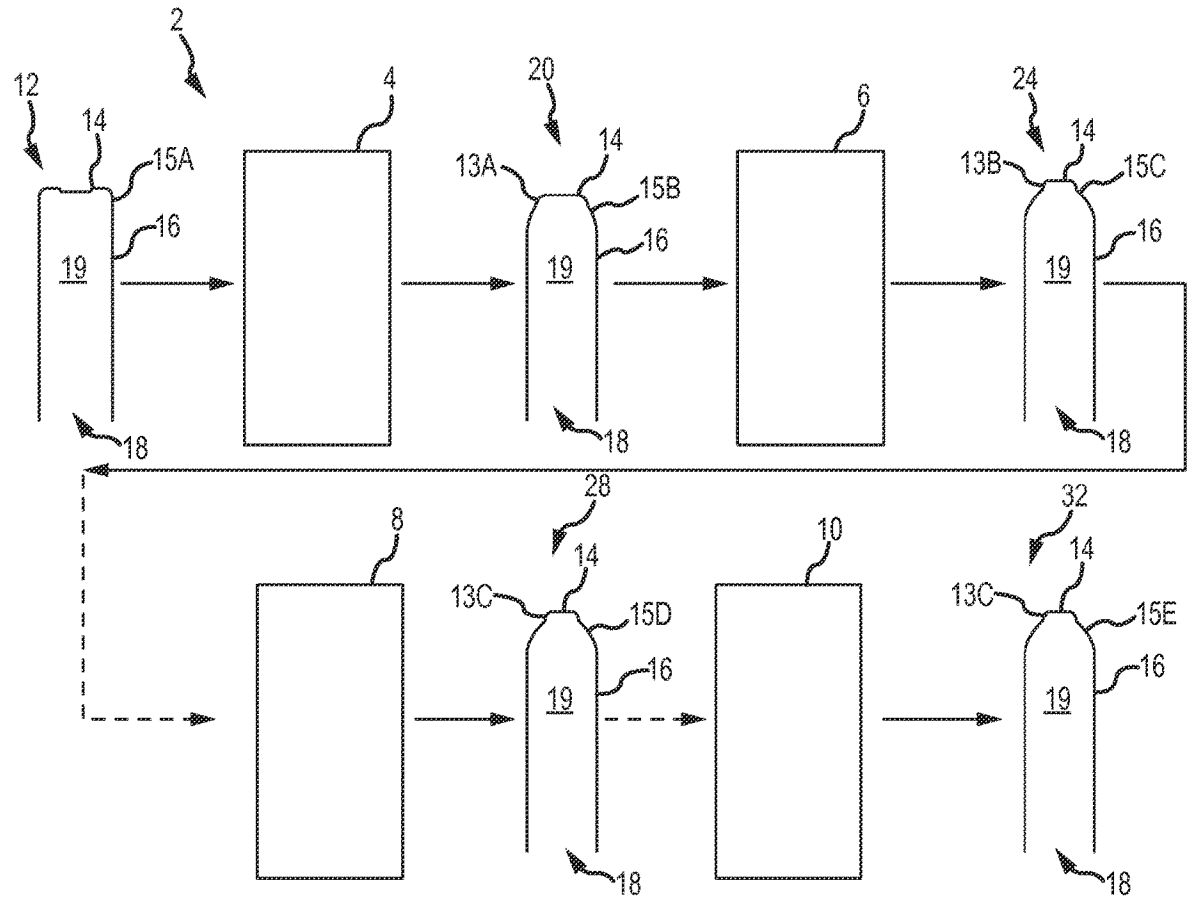
FIG. 1 is a schematic flow diagram of an embodiment of the present invention which depicts a system for simultaneously forming a contoured shoulder and a neck portion on a closed endwall of a metallic container body.
Figure 2A:
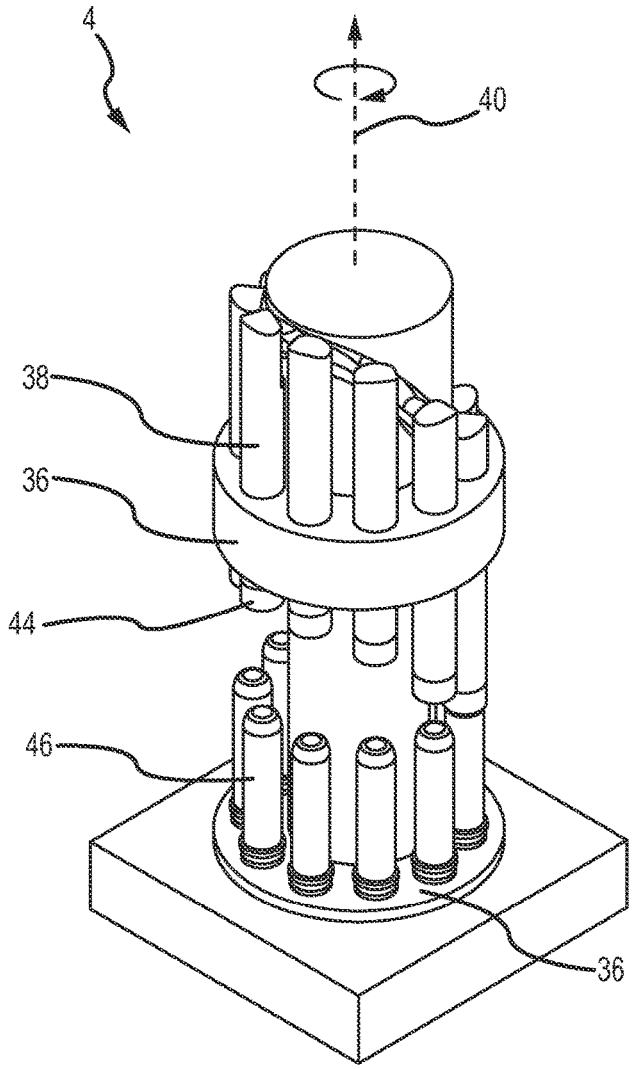
FIG. 2A is a perspective view of a first drawing press according to one embodiment of the present invention.
Figure 2B:
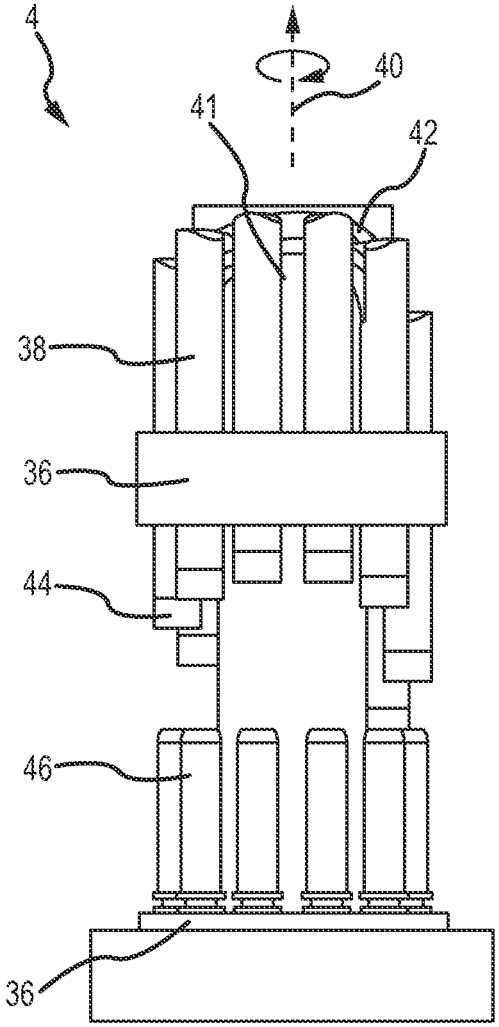
FIG. 2B is a front elevation view of the first drawing press of FIG. 2A.
Figure 2C:
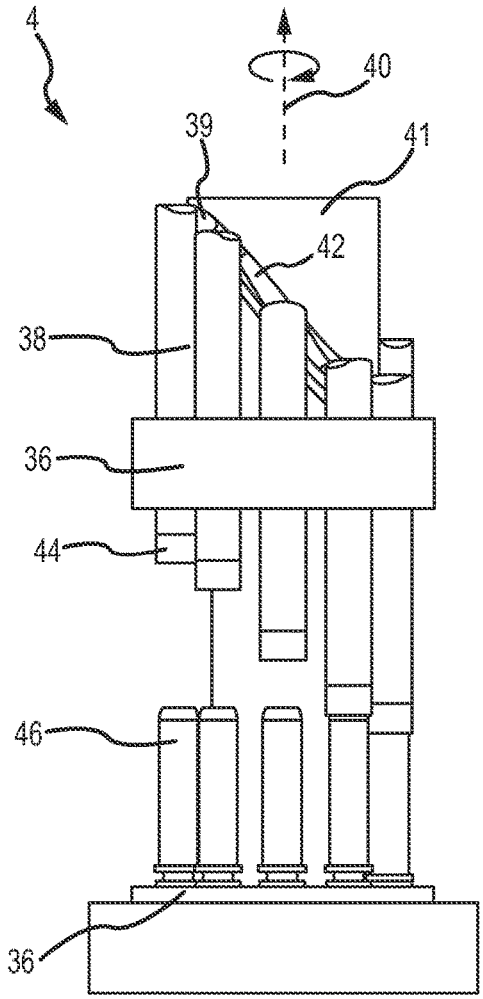
FIG. 2C is a side elevation view of the first drawing press of FIG. 2A.
Figure 2D:
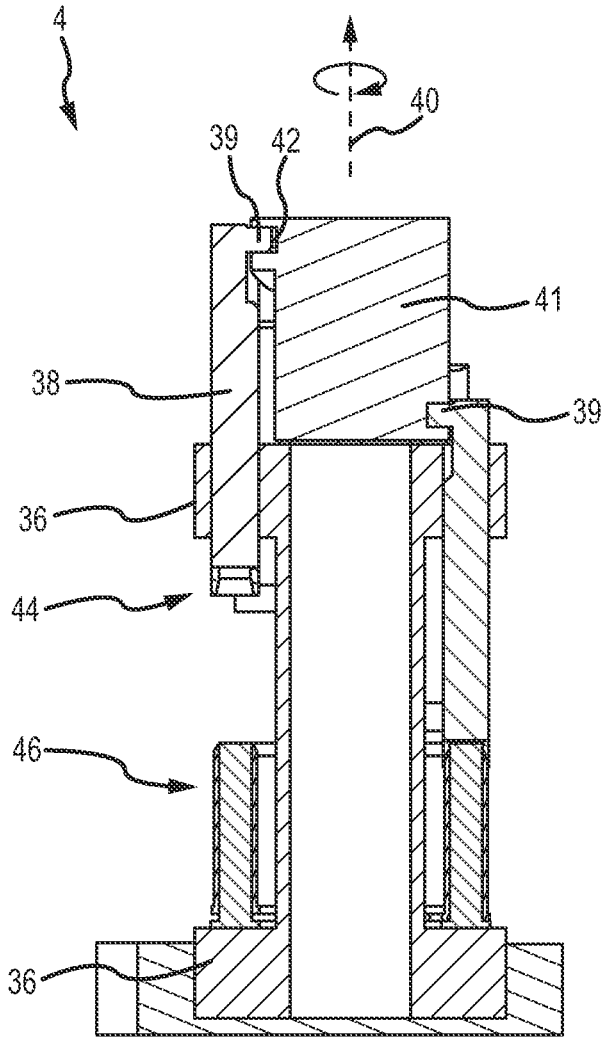
FIG. 2D is a cross-sectional view of the first drawing press of FIG. 2A.
Figure 2E:
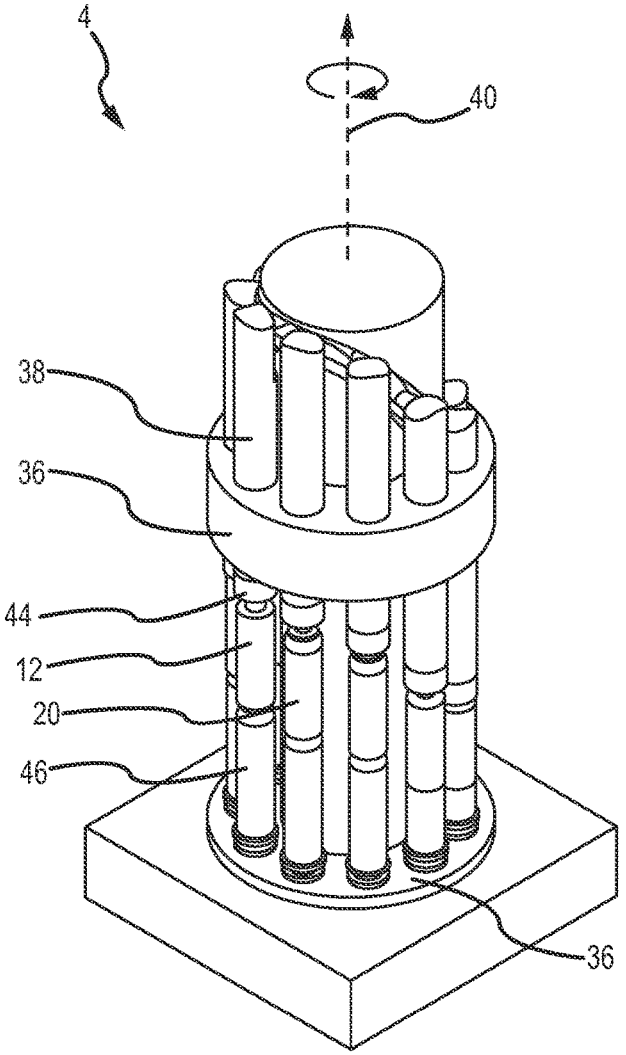
FIG. 2E is a perspective view of the first drawing press of FIG. 2A forming a contoured shoulder and neck portion on a metallic container body.
Figure 2F:
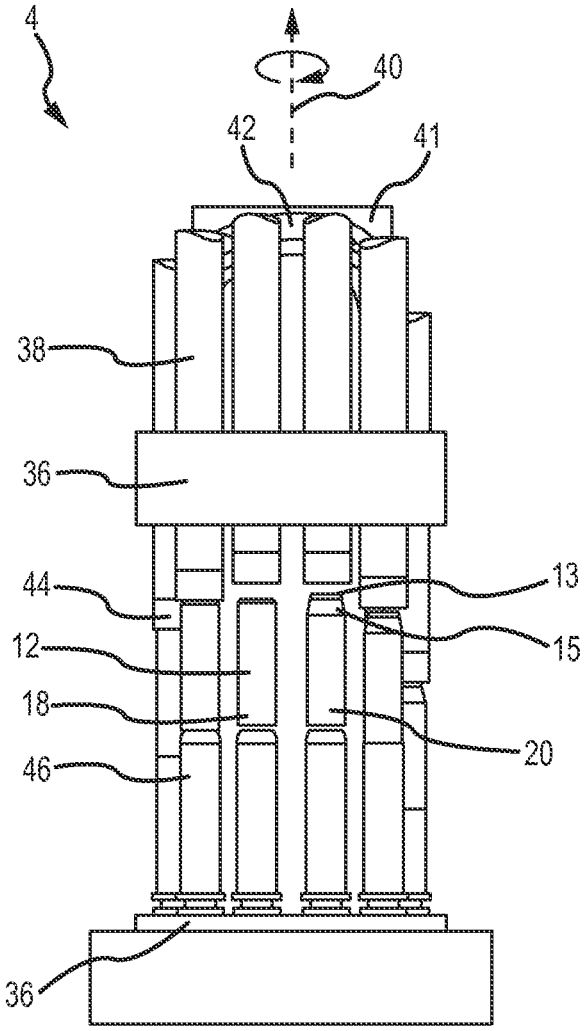
FIG. 2F is a front elevation view of the first drawing press of FIG. 2A forming a contoured shoulder and neck portion on a metallic container body.
Figure 2G:
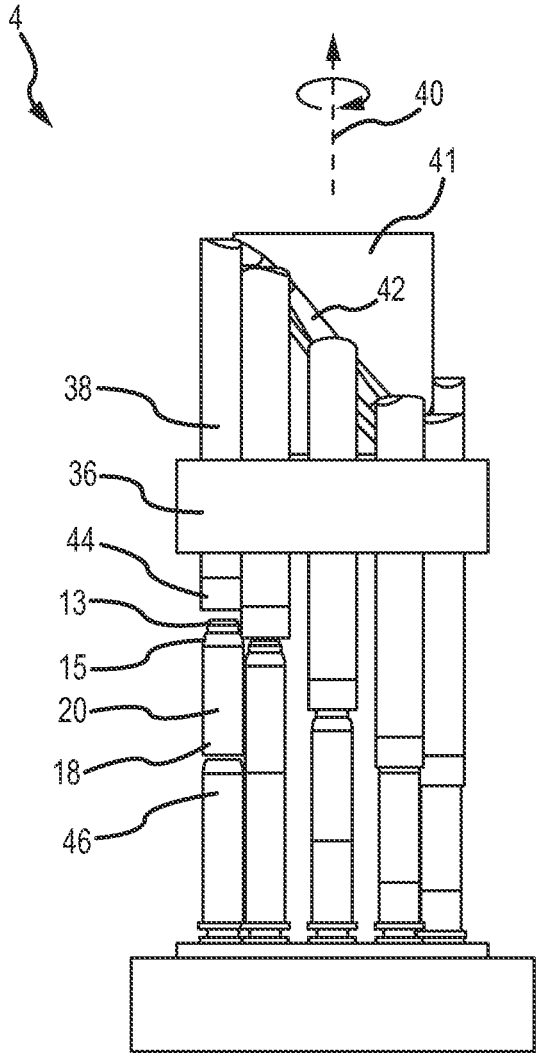
FIG. 2G is a side elevation view of the first drawing press of FIG. 2A forming a contoured shoulder and neck portion on a metallic container body.
Figure 2H:
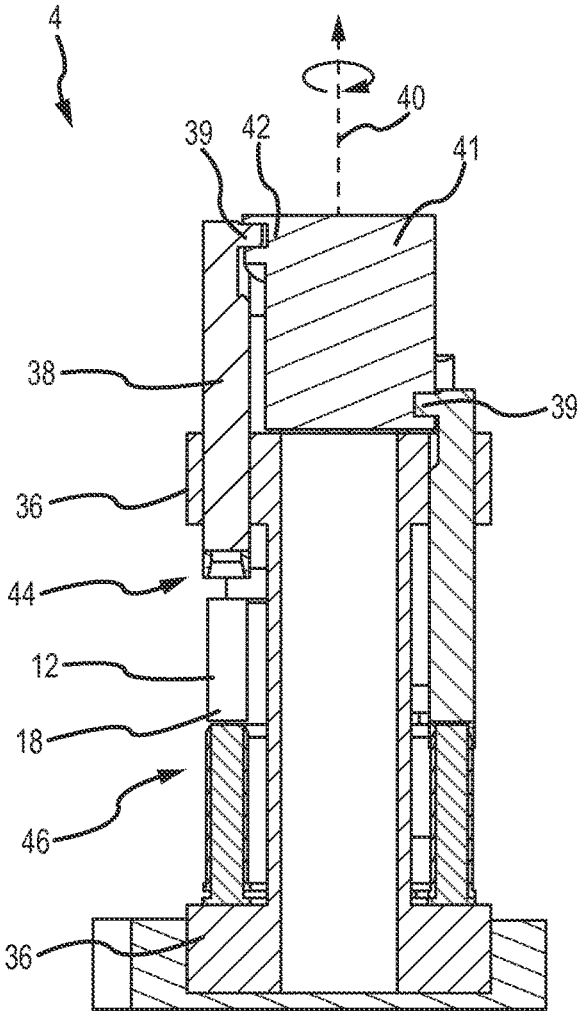
FIG. 2H is a cross-sectional view of the first drawing press of FIG. 2A forming a contoured shoulder and neck portion on a metallic container body.

Similar components and/or features may have the same reference number. Components of the same type may be distinguished by a letter following the reference number. If only the reference number is used, the description is applicable to any one of the similar components having the same reference number.

To assist in the understanding of one embodiment of the present invention the following list of components and associated numbering found in the drawings is provided herein:

| Number | Component |
|---|---|
| 2 | Forming apparatus |
| 4 | First drawing press |
| 6 | Second drawing press |
| 8 | Third drawing press |
| 10 | Fourth drawing press |
| 12 | Metallic container body |
| 13 | Neck portion |
| 14 | Closed endwall |
| 15 | Shoulder |
| 16 | Container sidewall |
| 17 | Neck height |
| 18 | Open end |
| 19 | Hollow interior |
| 20 | Container body after first drawing press |
| 24 | Container body after second drawing press |
| 28 | Container body after third drawing press |
| 30 | First radius between neck and shoulder |
| 32 | Container body after fourth drawing press |
| 34 | Second radius between neck and shoulder |
| 36 | Rotating turret |
| 38 | Rams |
| 39 | Cam follower |
| 40 | Axis |
| 41 | Stationary portion |

-continued

| Number | Component |
|---|---|
| 42 | Groove |
| 44 | Upper tooling assembly |
| 46 | Lower tooling assembly |
| 48 | First draw die |
| 49 | Draw die recess |
| 50 | First draw ring |
| 51 | Diameter of recess |
| 52 | First form punch |
| 54 | Face portion of the first draw ring |
| 56 | Leading end portion of the first draw ring |
| 58 | Leading end portion of the first draw die |
| 59 | Draw die face portion |
| 60 | Second draw die |
| 61 | Draw die recess |
| 62 | Second draw ring |
| 63 | Diameter of die recess |
| 64 | Second form punch |
| 66 | Face portion of the second draw die |
| 68 | Face portion of the second draw ring |
| 69 | Draw die recess |
| 70 | Third draw die |
| 71 | Face portion of third draw die |
| 72 | Upper clamping ring |
| 73 | Diameter of die recess |
| 74 | Third draw ring |
| 75 | Face portion of third draw ring |
| 76 | Third form punch |
| 78 | Lower clamping ring |
| 79 | Face portion of upper clamping ring |
| 80 | Face portion of lower clamping ring |
| 81 | Face portion of fourth draw die |
| 82 | Fourth draw die |
| 83 | Recess of fourth draw die |
| 84 | Pilot |
| 85 | Pilot end portion |
| 86 | Second clamping ring |
| 87 | Inner surface portion of container endwall |
| 88 | Face portion of second clamping ring |
| 91 | First portion of draw die face |
| 92 | Second portion of draw die face |
| 93 | First portion clamping ring |
| 94 | Second portion of clamping ring |
| 96 | Trimming punch |
| 98 | Trimming die |
| 100 | Metallic container body |
| 102 | Top opening |
| 104 | Bottom opening |

DETAILED DESCRIPTION

The present invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed. To acquaint persons skilled in the pertinent arts most closely related to the present invention, a preferred embodiment that illustrates the best mode now contemplated for putting the invention into practice is described herein by, and with reference to, the annexed drawings that form a part of the specification. The exemplary embodiment is described in detail without attempting to describe all of the various forms and modifications in which the invention might be embodied. As such, the embodiments described herein are illustrative, and as will become apparent to those skilled in the arts, may be modified in numerous ways within the scope and spirit of the invention.

Although the following text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning.

Referring now to FIG. 1, a forming apparatus 2 for simultaneously forming a contoured shoulder and a neck portion in a closed dome portion of a metallic container body 12 is illustrated. The forming apparatus 2 generally includes a first drawing press 4, a second drawing press 6, a third drawing press 8, and a fourth drawing press 10. In one embodiment, the forming apparatus 2 is adapted to form a contoured shoulder and a neck portion for a two-piece aerosol container having a diameter of approximately $2^{11}/_{16}$ inches (commonly known as a "211" container) and a height of approximately $6^{4}/_{16}$ inches (a "604" height) or approximately $7^{13}/_{16}$ inches (a "713" height). However, as will be appreciated by one of skill in the art, the forming apparatus 2 can be adapted to form a contoured shoulder and a neck portion on metallic containers of any size and for any type of product. In one embodiment, the forming apparatus 2 is operable to simultaneously form a contoured shoulder and a neck portion on more than about 200 metallic container bodies per minute and, more preferably, more than about 600 metallic container bodies per minute. The first drawing press 4 receives the metallic container body 12 which has been formed in advance in a previous cupper operation. In one embodiment of the present invention, the first drawing press 4 receives the metallic container body 12 formed in a draw and ironing process. However, as will be appreciated by one of skill in the art, the container body received by the first drawing press 4 may be formed by any method.

The metallic container body 12 generally includes a closed endwall 14, a shoulder 15A with a first shape, a sidewall portion 16 that has been trimmed to a predetermined height, an open end 18, and a hollow interior 19. In one embodiment, the metallic container body 12 has an inside diameter of between about 2.0 inches and about 5 inches. In another embodiment, the metallic container body 12 has an inside diameter of between about 2.540 inches and about 2.628 inches. In still another embodiment, the inside diameter is between about 2.560 inches and about 2.608 inches. In one embodiment, the metallic container body 12 has a height of between about 4 inches and about 12 inches. In one embodiment, the metallic container body 12 has a height of between about 6.439 inches and about 6.539 inches. In another embodiment, the height is between about 6.464 inches and about 6.514 inches. In still another embodiment, the metallic container body 12 has a height of between about 8.006 inches and about 8.106 inches. In another embodiment, the height is between about 8.031 inches and about 8.081 inches.

Optionally, the first drawing press 4 may receive the metallic container body 12 from a balancer (not illustrated). The balancer maintains the proper speed and flow of metallic container bodies through the forming apparatus 2. The balancer, in one embodiment, is a mechanical sponge that controls the flow of metallic container bodies 12 between previous formation stages and the first drawing press 4. Thus, the balancer maintains the proper speed and flow of the metallic container bodies to ensure a consistent, non-interrupted flow of metallic container bodies 12 into the first drawing press 4. The balancer accumulates metallic container bodies from the formation stage prior to the first drawing press 4 to ensure the forming apparatus 2 is supplied with metallic container bodies if upstream equipment goes offline, for example, for maintenance, during unscheduled stops, or when new coils of sheet metal are loaded in the uncoiler (not illustrated).

Each drawing press 4, 6, 8, 10 may include a rotating turret with rams and tooling adapted to successively form a contoured shoulder 15 and neck portion 13 on the metallic container body 12. The rotating turret, rams, and tooling of the presses 4, 6, 8, 10 are described in more detail below. In one embodiment of the present invention, the rams and tooling of the presses are cam actuated.

When the metallic container body 20 leaves the first drawing press 4, the shoulder 15B has a second shape and the neck portion 13A has a first diameter. The metallic container body 20 is then received by the second drawing press 6 where a shoulder 15C with a third shape is formed and a neck portion 13B with a second diameter that is less than the first diameter is simultaneously formed. The third drawing press 8 then optionally receives the metallic container body 24 and forms a shoulder 15D with a fourth shape and again reduces the diameter of the neck portion to form a neck portion 13C with a third diameter that is less than the second diameter. The tooling of the first, second, and third drawing presses 4, 6, 8 includes draw dies and draw rings with face shapes that are different than the face shape of the shoulder portion of the metallic container to be formed. The draw dies and draw rings used in the first, second, and third drawing presses 4, 6, 8 function to change the shape of the shoulder portion of the metallic container to conform to the shapes of the respective draw die and draw ring. In one embodiment, the draw dies of the first and second drawing presses 4, 6 have concave faces that have a generally arcuate shape. In another embodiment of the present invention, the draw die faces of the first and second drawing presses 4, 6 have a maximum internal diameter that is greater than the exterior diameter of the container body. In still another embodiment, the draw die of the third drawing press 8 has a maximum internal diameter that is not greater than the maximum external diameter of the neck portion of the container body received from the second drawing press 6.

In one embodiment, each of the first, second, and third presses 4, 6, 8 include a punch that remains substantially stationary during forming operations performed by the presses. In another embodiment, the punch of the third press 8 remains substantially stationary during a forming operation performed by the third press. In yet another embodiment, the punch of the third drawing press has an outer circumferential edge that is not rounded and is substantially perpendicular to a longitudinal side of the punch.

In one embodiment, during at least a portion of each of the first, second, and third forming operations, substantially all of the interior surface portions of the closed endwall, neck portion, and shoulder of the container body are in contact with a combination of one or more tools of the respective first, second, and third presses 4, 6, 8. Optionally, in another embodiment of the present invention, the tooling of the second and third drawing presses 6, 8 is adapted to reduce the diameter of the neck portion of the container body without substantially changing the height of the neck portion. Thus, the height of the neck portion formed by the first press 4 does not change in subsequent forming operations.

In still another embodiment, the neck height is altered during an operation performed by one of the presses 4, 6, 8. More specifically, in one embodiment, the height of the neck portion is reduced by at least one of the presses 4, 6, 8.

Finally, the fourth drawing press 10 may optionally receive the metallic container body 28. The metallic container body 32 leaves the fourth drawing press 10 with a shoulder 15E with a fifth shape. The fourth drawing press 10 does not change the third diameter of the neck portion 13C. In one embodiment, during a fourth forming operation performed by the fourth press 10, only a selected portion of the shoulder of the container body is reformed. Thus, the shoulder is not reformed in its entirety. In another embodiment, the selected portion of the shoulder that is reformed is a radially innermost portion proximate to the neck. In still another embodiment, the selected portion of the shoulder that is reformed comprises less than one-half of the length of the shoulder.

In one embodiment, the maximum internal diameter of a concave face portion of a draw die of the fourth press 10 is less than the maximum external diameter of the shoulder portion and less than a maximum external diameter of a convex face portion of a clamping ring of the fourth press 10. In one embodiment, the clamping ring of the fourth press 10 is adapted to contact substantially all of the interior surface portion of the shoulder. Further, in another embodiment, cross-sectional profiles of the concave face of the draw die and the convex face of the clamping ring are not substantially straight and have shapes that are different than the shape of the shoulder before the forming operation performed by the fourth press 10 begins. In one embodiment, the draw die face and the clamping ring face have a cross-sectional profile that includes a first portion and a second portion with a different slope. In another embodiment, the draw die face and the clamping ring face have an arcuate shape.

In another embodiment of the present invention, the fourth press 10 includes a pilot positioned at a radially innermost position within the container body. During the fourth forming operation, the pilot does not push an interior surface portion of the closed endwall of the container body. In still another embodiment, the pilot does not contact the interior surface portion of the closed endwall. Optionally, in another embodiment of the present invention, the tooling of the fourth drawing press 10 is adapted to reshape a portion of the shoulder portion of the container body without increasing the height or the diameter of the neck portion. However, in another embodiment, one or more of the height and the diameter of the neck portion change during the fourth operation performed by the fourth press 10. For example, the neck portion may be shortened by up to approximately 0.02 inches during the fourth forming operations.

One of ordinary skill in the art will appreciate that the order of the drawing presses 4, 6, 8, 10 may be altered and/or repositioned in a variety of ways. For example, in one embodiment, one or more of the drawing presses 4, 6, 8, 10 are eliminated. Further, it will be recognized that order of the drawing presses, and the number of the drawing presses used, may be selected to form a metallic container body with a shoulder and neck portion having any predetermined shape, height, and diameter. For example, in one embodiment of the present invention, two or three drawing presses may be used. In another embodiment, five or six drawing presses may be used.

In addition, the fourth drawing press 10 may be adapted to receive a metallic container body from either the first or second drawing presses 4, 6. Said another way, the number of forming operations may be reduced if the external diameter of the neck portion of the finished container is larger than the third diameter of neck portion 13C. Thus, it is possible to omit one or more of the forming operations of drawing presses 4, 6, 8, and 10.

In one embodiment, the first drawing press 4 has a clamp force of approximately 3,750 lbf and a draw force of approximately 3,900 lbf. In another embodiment, the second drawing press 6 has a clamp force of approximately 3,000 lbf and a draw force of approximately 3,450 lbf. In yet another embodiment, the third drawing press 8 has a clamp force of approximately 1,950 lbf and a draw force of approximately 2,175 lbf. In still another embodiment, a clamp force of the fourth drawing press 10 is approximately 1,000 lbf and a draw force is approximately 1,000 lbf. It will be appreciated by one of skill in the art that the clamp forces and draw forces of drawing presses 4, 6, 8, 10 may be increased or decreased and still comport with the scope and spirit of the present invention.

Referring now to FIGS. 2A-2D, the first drawing press 4 of one embodiment of the present invention is illustrated. Those of skill in the art will appreciate that each of the drawing presses 4, 6, 8, 10 have generally similar features but that each of presses 4, 6, 8, 10 have different tooling, or tooling with different shapes and dimensions, to simultaneously form the shoulder 15 and neck portion 13 on the metallic container body.

In one embodiment, each drawing press 4, 6, 8, 10 includes a rotating turret 36. Rams 38 are operably interconnected to, and substantially evenly spaced around, the turret 36. Each ram 38 is aligned substantially parallel to a center axis 40 of the turret 36. The rams 38 each include a cam follower 39, illustrated in FIGS. 2C-2D, actuated by a groove 42 formed in a stationary column 41 of the press 4. In one embodiment, the groove 42 has a generally arcuate shape formed radially around the stationary column 41 of the press. As will be appreciated by those of skill in the art, any number of rams 38 can be interconnected to the turrets 36 of the drawing presses 4, 6, 8, 10. In one embodiment, each drawing press 4, 6, 8, 10 has between four and sixteen rams 38. In a more preferred embodiment, each drawing press 4, 6, 8, 10 has ten rams interconnected to the turrets 36. One of skill in the art will appreciate that the drawing presses 4, 6, 8, 10 do not have to have a rotating turret. For example, in one embodiment, each drawing press includes one or more sets of tools operably aligned to form a contoured shoulder and a neck portion on a metallic container body in a number of operations without a rotating turret.

Tooling used to form the contoured shoulder and neck portion, described in more detail below, is interconnected to each of the rams 38 in an upper tooling assembly 44 and to opposing surfaces of the turret 36 at a lower tooling assembly 46. The lower assembly 46 is positioned below and substantially coaxially aligned with each ram 38. Each of the presses 4, 6, 8, 10 include sets of forming tooling adapted to perform a forming operation of a single type. As will be recognized by one of ordinary skill in the art, tooling assemblies 44, 46 can have any predetermined orientation and the arrangement of assemblies 44, 46 may be altered and still comport with the scope and spirit of the present invention. As will be appreciated by one of skill in the art, the tooling of the lower tooling assembly 46 may also be adapted to move as the turret 36 rotates. For example, in one embodiment of the present invention, at least some of the tooling of the lower tooling assembly 46 of presses 4, 6, 8, 10 is operable to move axially as each press performs a forming operation. In another embodiment, the lower tooling assembly 46 of presses 4, 6, 8, 10 includes a cam follower 39 associated with a cam 42 adapted to move selected tooling of the lower tooling assemblies 46. In still another embodiment, at least some of the tooling of the lower tooling assembly 46 of each press is biased axially toward the upper tooling assembly 44. During a forming operation, the biased tooling of the lower assembly 46 may move axially in response to a force originating from the tooling of the upper assembly 44.

Referring now to FIGS. 2E-2H, container bodies are reformed as the first drawing press 4 performs a first forming operation. The container bodies are illustrated in a position between the tooling of the assemblies 44, 46 for clarity. In operation, the trimmed metallic container body 12 (illustrated in FIG. 2E) is loaded into the first drawing press 4 by any method known to those of skill in the art. In one embodiment, the metallic container body 12 is held in a generally vertical orientation that is substantially parallel with the longitudinal center axis 40 of the turret 36 with the open end 18 facing downwardly. Those of skill in the art will appreciate that the metallic container body 12 may have any desired orientation in the drawing presses. For example, in one embodiment, the metallic container bodies may be oriented substantially perpendicular to the longitudinal axis 40 of the press. The turret 36 rotates continuously without the need for indexing. In one embodiment, the turret 36 rotates at approximately sixty rotations per minute (60 rpm). The turret 36 may rotate in either direction. In one embodiment, the turret 36 rotates clockwise as viewed from above. As the turret 36 rotates, each of the rams 38 and the interconnected tooling separately moves through a motion path of a forward and return stroke with each full rotation of the turret 36. In one embodiment, the stroke is between about 11.5 inches and about 12.5 inches while the stroke has a working load rated at 4,000 lbf or more.

The stroke of the rams 38 forces the tooling into the hollow interior 19 of the metallic container body 12. The tooling forms and/or draws the closed endwall 14 of the metallic container body 12 to form the shoulder 15 and the neck portion 13. The rams 38 then retract as the turret 36 continues to rotate and the formed and drawn metallic container body 20 is discharged from the first drawing press 4. The metallic container body 20 is subsequently received and formed serially by one or more of the second drawing press 6, the third drawing press 8, and the fourth drawing press 10.

Figure 3B:
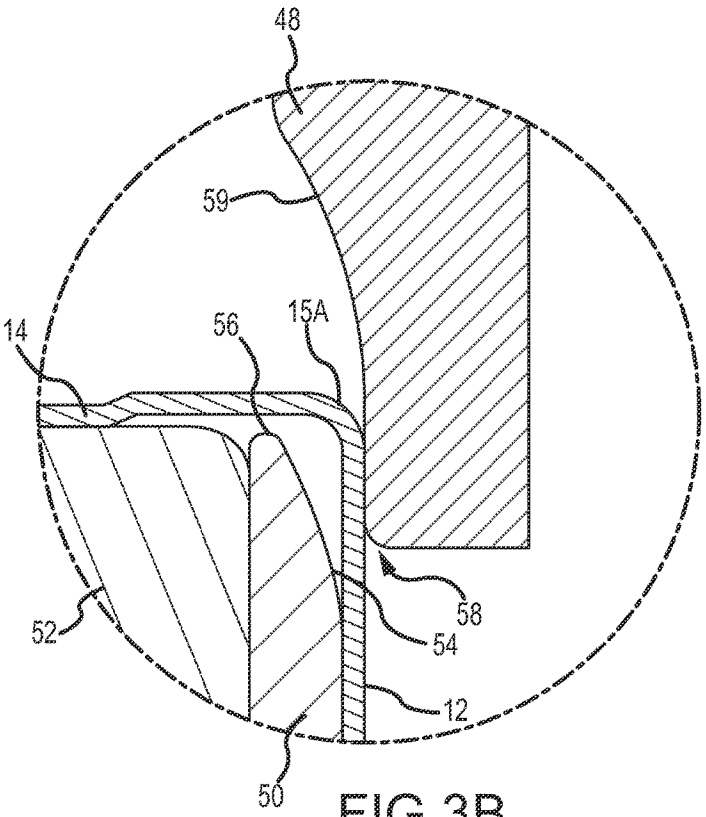
FIG. 3B is a detailed cross-sectional front elevation view of a portion of FIG. 3A.
Figure 3A:
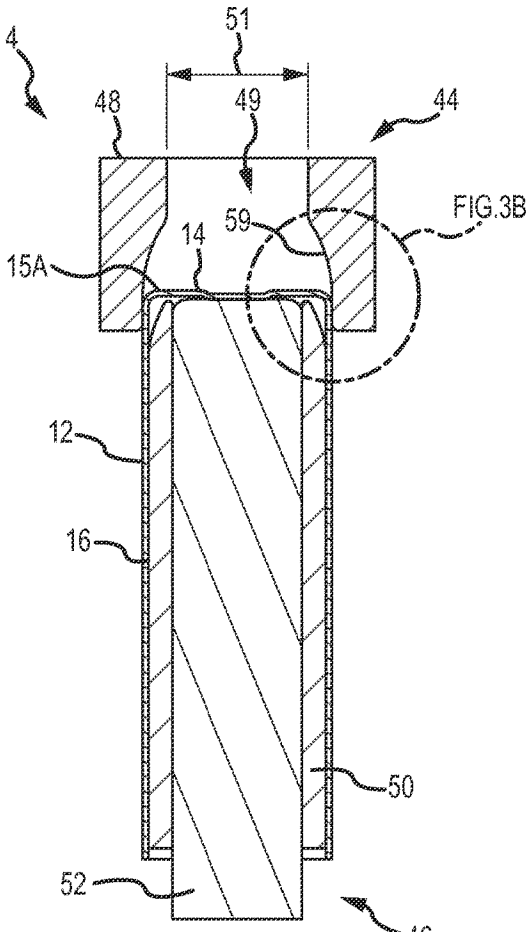
FIG. 3A is a longitudinal cross-sectional front elevation view of a first position of operation of tooling of the first drawing press as a first forming stroke begins according to one embodiment of the present invention.

Referring now to FIGS. 3A-3B, longitudinal cross-sectional front elevation views of a first position of operation of the tooling 44, 46 of the first drawing press 4 are illustrated as a first forming stroke begins according to one embodiment of the present invention. The upper tooling assembly 44 of the first drawing press 4 generally comprises a first draw die 48. The first draw die 48 includes a recess 49 and a concave face portion 59. The face portion 59 is adapted to contact an exterior surface of the container body 12. The recess 49 has a generally cylindrical shape with substantially linear walls having an interior diameter 51. The lower tooling assembly 46 generally comprises a first draw ring 50 and a first form punch 52. The first draw ring 50 has a generally cylindrical shape with a face portion 54. The die 48, draw ring 50, and form punch 52 are arranged substantially coaxially.

The metallic container body 12 is positioned on the first draw ring 50 and the first form punch 52. A face portion 54 of the first draw ring 50 contacts an interior surface of the closed endwall 14 of the metallic container body 12. Cross-sectional profiles of the face portion 54 of the first draw ring 50 and the face portion 59 of the first draw die 48 have a curved or generally arcuate shape. A leading end portion 56 of the first draw ring 50 has a shape that is not identical to the curved face shape of an inner surface of the shoulder 15A of the metallic container body 12. A leading end portion 58 of the first draw die 48 has a shape that is not identical to the curved face shape of an outer surface of the shoulder 15A of the metallic container body 12.

Figure 4B:
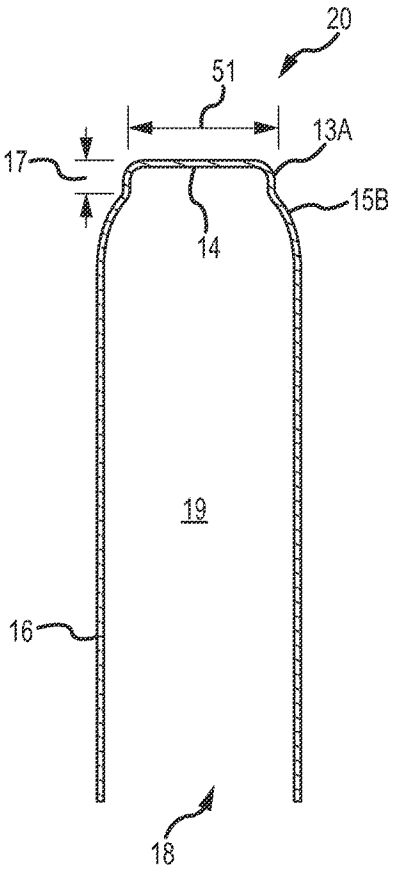
FIG. 4B is a longitudinal cross-sectional front elevation view of a metallic container body after the first forming stroke of the first drawing press is completed according to one embodiment of the present invention.

As the face portion 54 of the first draw ring 50 and face portion 59 of the first draw die 48 converge toward each other, a clamping force is applied to the shoulder 15A of the container. This force works to shape the shoulder to create a larger radius while simultaneously forming a chimney or a neck portion 13A in the upper portion of the metallic container body 14 as shown in FIG. 4B.

Figure 4A:
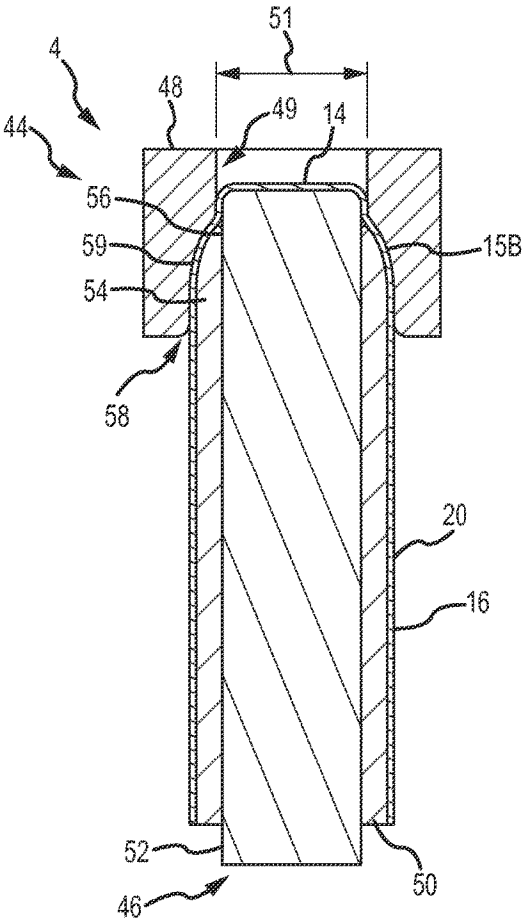
FIG. 4A is a longitudinal cross-sectional front elevation view of a second position of operation of tooling of the first drawing press as the first forming stroke is completed according to one embodiment of the present invention.

Referring now to FIG. 4A, a second position of operation of the tooling 44, 46 of the first drawing press 4 is illustrated as the first forming stroke is completed according to one embodiment of the present invention. As shown, the first draw die 48 is moved toward the container body. The face portion 59 of the first draw die 48 contacts and applies a force to the outer face of the closed endwall 14 of the metallic container body 12. The first form punch 52 holds the metallic container body 12 in place while the first draw die 48 and first draw ring 50 compress the closed endwall 14 and simultaneously form a shoulder 15B with a second shape and a neck portion 13A with a first diameter on the metallic container body 20, illustrated in FIG. 4B. The first diameter of the neck portion 13A is substantially equal to the interior diameter 51 of the draw die recess 49. The neck portion 13A has a predetermined height 17.

In one embodiment, the maximum interior diameter of the draw die face portion 59 is greater than the exterior diameter of the container sidewall portion 16. In another embodiment, the first form punch 52 remains substantially stationary during the first forming operation. In yet another embodiment, the first draw ring 50 moves axially during at least a portion of the first forming operation. In still another embodiment, during at least one portion of the first forming operation, substantially all of the interior surface portions of the closed endwall 14, neck portion 13, and shoulder 15 of the container 20 are in contact with a combination of the first draw ring 50 and the first form punch 52.

In one embodiment, when the metallic container body leaves the first drawing press 4, the metallic container body 20 has a height of between about 4 inches and about 11 inches. In another embodiment, the height is between about 6.8 inches and about 7.0 inches. In still another embodiment, the height of the metallic container body 20 is between about 8.36 inches and about 8.56 inches.

Figures 5A, 5B:
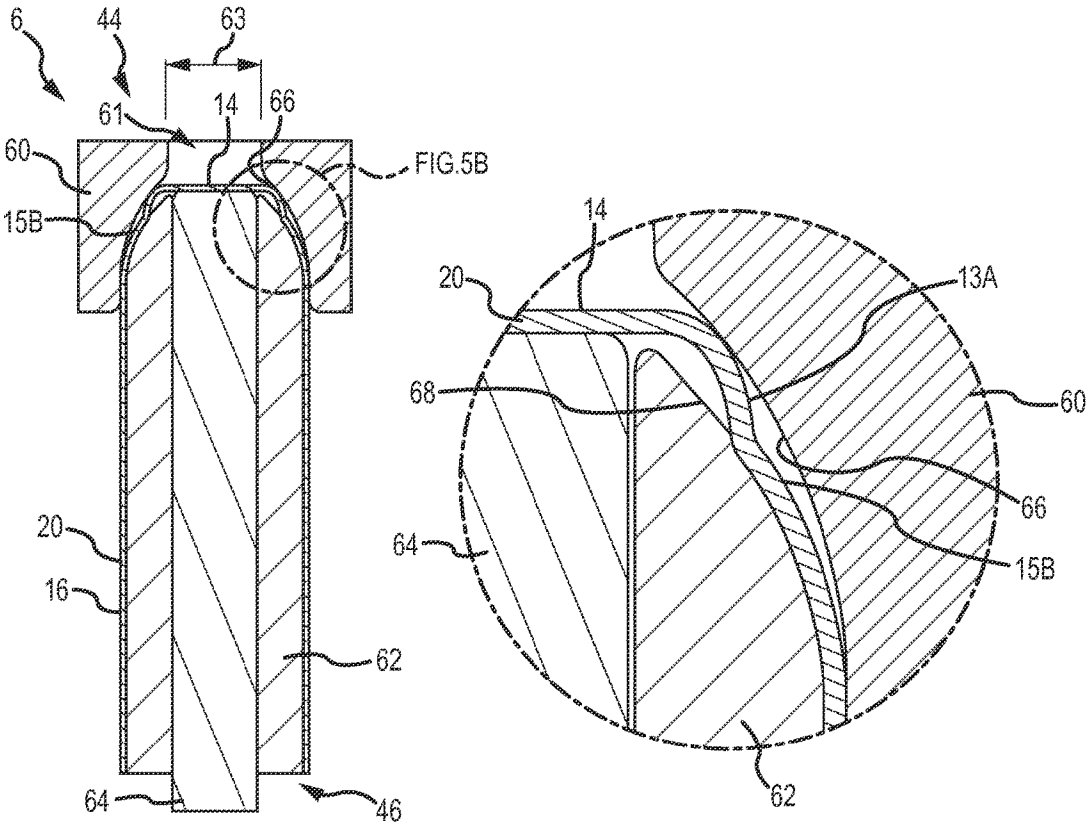
FIG. 5A is a longitudinal cross-sectional front elevation view of a first position of operation of tooling of the second drawing press as a second forming stroke begins according to one embodiment of the present invention.
FIG. 5B is a detailed cross-sectional front elevation view of a portion of FIG. 5A.

Referring now to FIGS. 5A-5B, longitudinal cross-sectional front elevation views of a first position of operation of the tooling 44, 46 of the second drawing press 6 are illustrated as a second forming stroke begins according to one embodiment of the present invention. The upper tooling assembly 44 of the second drawing press 6 generally comprises a second draw die 60. The second draw die 60 includes a recess 61 and a concave face portion 66. The face portion 66 is adapted to contact an exterior surface of the container body 20. The recess 61 has a generally cylindrical shape with substantially linear walls having an interior diameter 63 that is less than diameter 51. The lower tooling assembly 46 generally comprises a second draw ring 62 and a second form punch 64. The die 60, draw ring 62, and form punch 64 are arranged substantially coaxially. The face portion 66 of the second draw die 60 and a face portion 68 of the second draw ring 62 do not have tapered shapes. In one embodiment, face portions 66, 68 have curved or generally "arcuate" shapes. The face portion 66 of the leading end portion of the second draw die 60 has a shape that is not identical to the curved shape of the outer face of the shoulder portion 15B of the metallic container 20. The face portion 68 of the leading end portion of the second draw ring 62 has a shape that is not identical to the curved shape of the inner face of the shoulder portion 15B of the metallic container 20.

The metallic container body 20 is received from the first drawing press 4 and positioned on the second draw ring 62 of the second drawing press 6. The second draw die 60 is positioned over the closed endwall 14 of the metallic container body 20 and moved into contact with the exterior surface of the metallic container body. The opposing face portions 66, 68 of the second draw die 60 and the second draw ring 62 come together on opposite surfaces of the shoulder 15B of the metallic container body 20. The second form punch 64 holds the metallic container body 20 in place while the second draw die 60 and second draw ring 62 press the shoulder 15B of the metallic container body 20 into the form of the curved faces 66, 68 of the second draw die 60 and second draw ring 62.

Figure 6B:
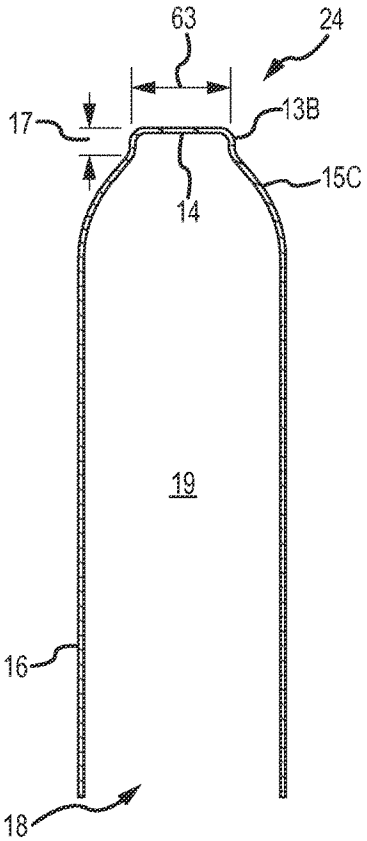
FIG. 6B is a longitudinal cross-sectional front elevation view of a metallic container body after the second forming stroke of the second drawing press is completed according to one embodiment of the present invention.
Figure 6A:
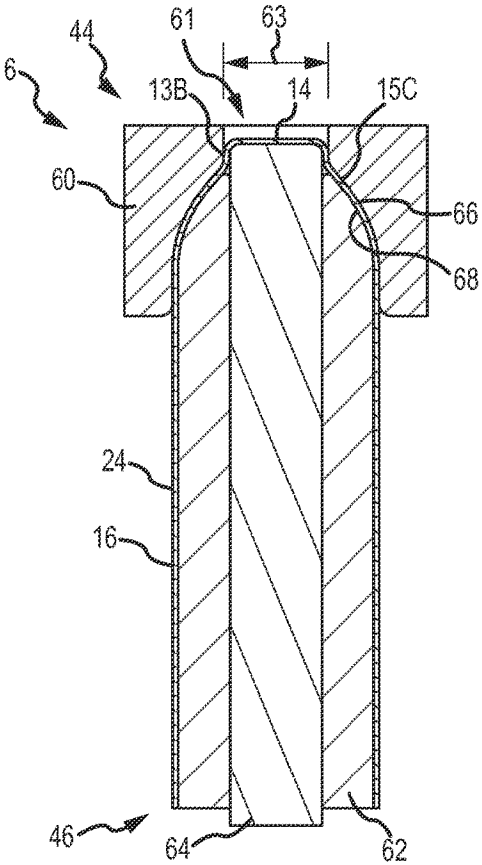
FIG. 6A is a longitudinal cross-sectional front elevation view of a second position of operation of tooling of the second drawing press as the second forming stroke is completed according to one embodiment of the present invention.

Referring now to FIG. 6A, a second position of operation of the tooling 44, 46 of the second drawing press 6 is illustrated as the second forming stroke is completed according to one embodiment of the present invention. The opposing faces portions 66, 68 of the second draw die 60 and the second draw ring 62 have contacted and applied force to opposite surfaces of the shoulder 15B in order to form a shoulder 15C with a third shape and simultaneously form a neck portion 13B with a second diameter that is less than the first diameter, as illustrated in FIG. 6B. The second diameter of the neck portion 13B is substantially equal to the interior diameter 63 of the draw die recess 61. The neck portion 13B has a height 17. In one embodiment, the height of neck portion 13B is substantially the same as the height 17 of the neck portion 13A of the metallic container body 20 after the first operation. In another embodiment, neck portion 13B has a height that is greater than the height of neck portion 13A. In still another embodiment, neck portion 13B has a height that is less than the height of neck portion 13A.

In one embodiment, the maximum interior diameter of the draw die face portion 66 is greater than the exterior diameter of the container sidewall portion 16. In another embodiment, the second form punch 64 remains substantially stationary during the second forming operation. In yet another embodiment, the second draw ring 62 moves axially during at least a portion of the second forming operation. In still another embodiment, during at least one portion of the second forming operation, substantially all of the interior surface portions of the closed endwall 14, neck portion 13, and shoulder 15 of the container 24 are in contact with a combination of the second draw ring 62 and the second form punch 64. In another embodiment of the present invention, the tooling of the second drawing press 6 is adapted to reduce the diameter 63 of the neck portion 13 of the container body without increasing the height 17 of the neck portion.

In one embodiment, when the metallic container body 24 leaves the second drawing press 6, the metallic container body 24 has a height of between about 5 inches and about 11 inches. In another embodiment, the height of the metallic container body 24 is between about 7.11 inches and about 7.31 inches. In still another embodiment, the height of the metallic container body 24 is between about 8.67 inches and about 8.87 inches.

Figure 7B:
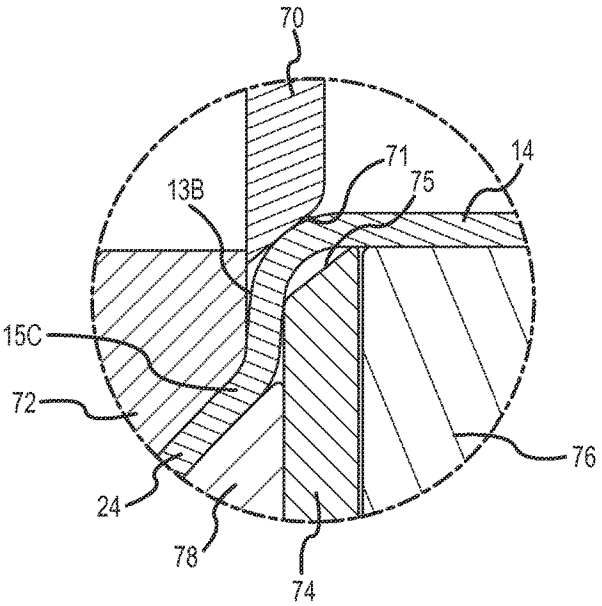
FIG. 7B is a detailed cross-sectional front elevation view of a portion of FIG. 7A.
Figure 7A:
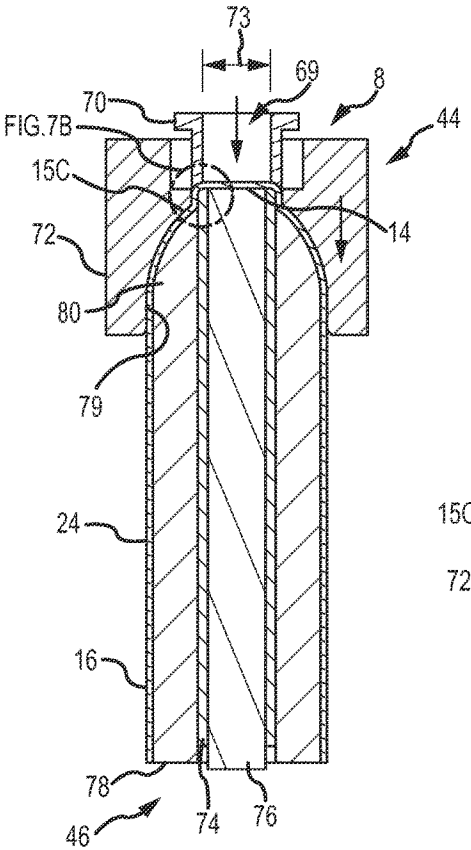
FIG. 7A is a longitudinal cross-sectional front elevation view of a first position of operation of tooling of the third drawing press as a third forming stroke begins according to one embodiment of the present invention.

Referring now to FIGS. 7A-7B, longitudinal cross-sectional front elevation views of a first position of operation of the tooling 44, 46 of the third drawing press 8 are illustrated as a third forming stroke begins according to one embodiment of the present invention. The upper tooling assembly 44 of the third drawing press 8 generally comprises a third draw die 70 positioned radially inwardly of an upper clamping ring 72. The third draw die 70 includes a recess 69 with a generally cylindrical shape with substantially linear walls having an interior diameter 73 that is less than diameter 63. The upper clamping ring 72 has a concave face portion 79 with a generally arcuate cross-section. The lower tooling assembly 46 generally comprises a third form punch 76, a third draw ring 74, and a lower clamping ring 78 arranged from a radially inward position to a radially outward position, respectively. The lower clamping ring 78 has a convex face portion 80 with a generally arcuate cross-section. The third draw die 70, upper clamping ring 72, third draw ring 74, third form punch 76, and the lower clamping ring 78 are arranged substantially coaxially.

The metallic container body 24 is received from the second drawing press 6 and positioned on the third draw ring 74 and the lower clamping ring 78 of the third drawing press 8. The third draw die 70 and the upper clamping ring 72 are positioned over the closed endwall 14 and the shoulder 15C, respectively. The face portion 71 of the leading end portion of the third draw die 70 has a shape that is not identical to the curved shape of the outer face of the shoulder portion 15C of the metallic container 24. The face portion 75 of the leading end portion of the third draw ring 74 has a shape that is not identical to the curved shape of the inner face of the neck portion 13B of the metallic container 24. In one embodiment of the present invention, the face portion 75 of the third draw ring 74 has an arcuate shape with a radius that is substantially the same as an arcuate radius of the face portion 80 of the lower clamping ring 78. Accordingly, the exterior faces 75, 78 are substantially tangent and describe a continuous surface at the end of the third forming stroke as illustrated in FIG. 9. In another embodiment, the face portions 75, 78 have a generally linear, or frustum, cross-sectional profile, although other profiles are contemplated.

Figure 8B:
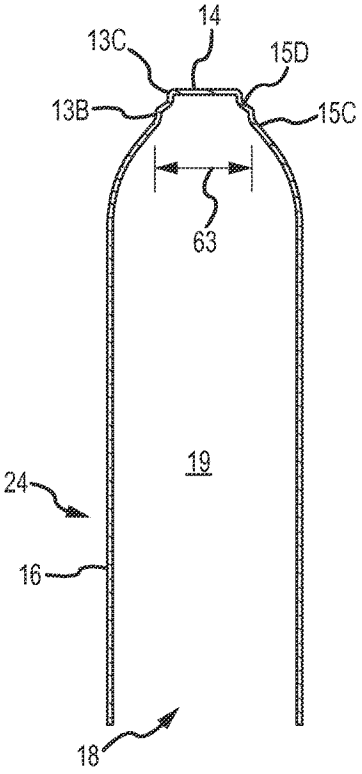
FIG. 8B is a longitudinal cross-sectional front elevation view of a metallic container body as the third forming stroke of the third drawing press is in progress according to one embodiment of the present invention.
Figure 8A:
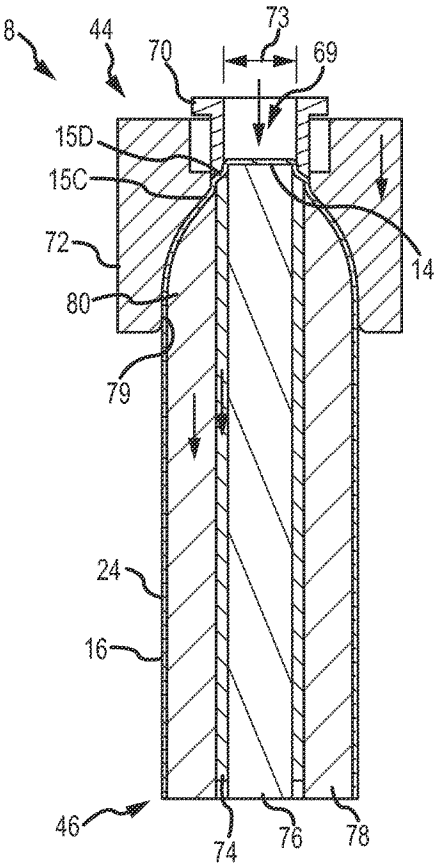
FIG. 8A is a longitudinal cross-sectional front elevation view of a second position of operation of tooling of the third drawing press as the third forming stroke is in progress according to one embodiment of the present invention.
Figure 9B:
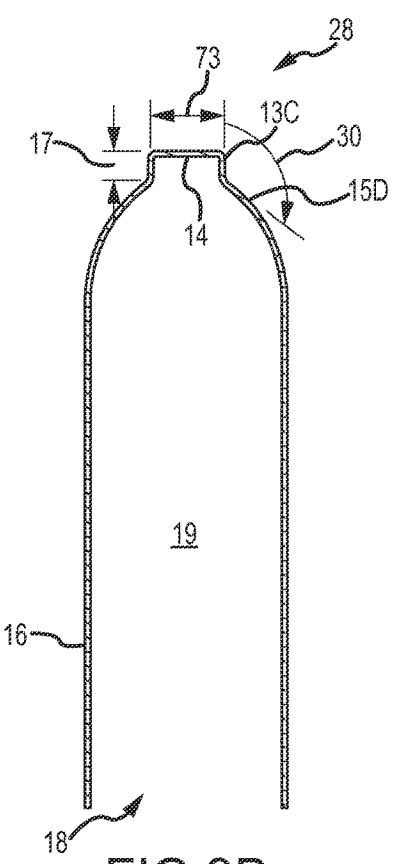
FIG. 9B is a longitudinal cross-sectional front elevation view of a metallic container body after the third forming stroke of the third drawing press is completed according to one embodiment of the present invention.
Figure 9A:
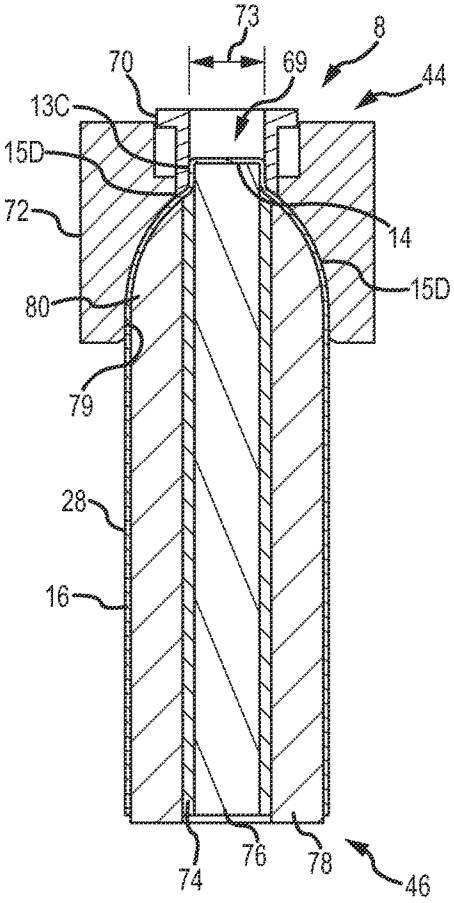
FIG. 9A is a longitudinal cross-sectional front elevation view of a third position of operation of tooling of the third drawing press as the third forming stroke is completed according to one embodiment of the present invention.

Referring now to FIGS. 8A and 9A, the third draw die 70 and the upper clamping ring 72 move into contact with the exterior surface portion of the metallic container body 24. In one embodiment of the present invention, the third draw die 70 and upper clamping ring 72 move downwardly. The third draw die 70 and the third draw ring 74 clamp down on opposing surfaces of the shoulder 15C of the metallic container body 24. While the third form punch 76 remains substantially stationary, the third draw die 70, third draw ring 74, and the upper and lower clamping rings 72, 78 move axially, thus forming a neck portion 13C on the metallic container body 24 while substantially simultaneously extending the shoulder portion 15D. The shoulder 15D is lengthened, or extended, simultaneously as the neck portion 13C is made diametrically smaller. Thus, the shoulder 15D is not extended after the neck portion 13C is made diametrically smaller. The neck portion 13C of body 28, illustrated in FIGS. 8B and 9B, has a third diameter 73 that is less than the second diameter 63 of neck portion 13B of the body 24 received from the second drawing press 6. The diameter 73 of the neck portion 13C is substantially equal to the interior diameter 73 of the recess 69 of the third draw die 70. In one embodiment, the third draw die 70 forces the reduction in the diameter of the body 28 while the third draw ring 74 rides against the inside surface of the body to prevent or reduce wrinkling. As will be appreciated by one of skill in the art, the clamping rings 72, 78 generally clamp a portion of the metallic container body adjacent to the neck portion that will be worked to a smaller diameter. Accordingly, the clamping rings 72, 78 help keep the material of the container body in tension in the radial/longitudinal directions. The tension provided by the clamping rings avoids or reduces wrinkling during the drawing operation performed by the third draw die 70 and the third draw ring 74.

The third drawing press 8 of the present invention does not use a die and pusher to reform or pinch the shoulder portion 15 in its entirety. Rather, the third draw die 70 and third draw ring 74 of the third drawing press 8 work to form the neck portion 13B of the metallic container body 24. At substantially the same time, the upper clamping ring 72 and the lower clamping ring 78 work to form the rest of the shoulder portion 15D of the metallic container body 24. At no point do the upper clamping ring 72 and the lower clamping ring 78 extend to reform a previously-formed face portion of the shoulder 15 to form or reform the neck portion 13 of the metallic container body.

In one embodiment, the maximum interior diameter of the face portion 79 of the upper clamping ring 72 is greater than the exterior diameter of the container sidewall portion 16. In another embodiment, the face portion 71 of the third draw die 70 has a maximum internal diameter that is not greater than the maximum external diameter 63 of the neck portion 13B of the container 24 after the second forming operation is completed. In another embodiment, the third form punch 76 remains substantially stationary during the third forming operation. In yet another embodiment, illustrated in FIG. 7B, the third form punch 76 has an outer circumferential edge that is substantially perpendicular to a longitudinal side of the punch.

In one embodiment, the third draw die 70, upper clamping ring 72, third draw ring 74, and the lower clamping ring 78 move axially during at least a portion of the third forming operation. In another embodiment, during at least one portion of the third forming operation, substantially all of the interior surface portions of the closed endwall 14, neck portion 13, and shoulder 15 of the container are in contact with a combination of the third form punch 76, the third draw ring 74, and the lower clamping ring 78. In still another embodiment of the present invention, the tooling 44, 46 of the third drawing press 8 is adapted to reduce the diameter of the neck portion of the container body during the third forming operation without increasing the height 17 of the neck portion 13.

Referring now to FIG. 9B, the container body 28 has a predetermined radius 30 between the neck portion 13C and the shoulder portion 15D after the third forming operation. In one embodiment, the radius of curvature 30 is between about 0.13 inches and about 0.19 inches. In a more preferred embodiment, the radius of curvature 30 is between about 0.06 and about 0.15 inches. The metallic container body 28 has a height of between about 5 inches and about 11 inches. In another embodiment, the height of the metallic container body 28 is between about 8.77 inches and about 8.97 inches. In still another embodiment, the height of the metallic container body 28 is between about 8.77 inches and about 8.97 inches.

Figure 10B:
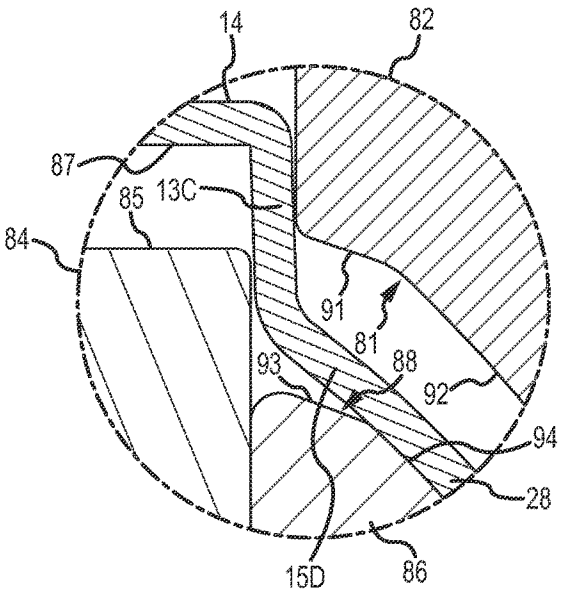
FIG. 10B is a detailed cross-sectional front elevation view of a portion of FIG. 10A.
Figure 10A:
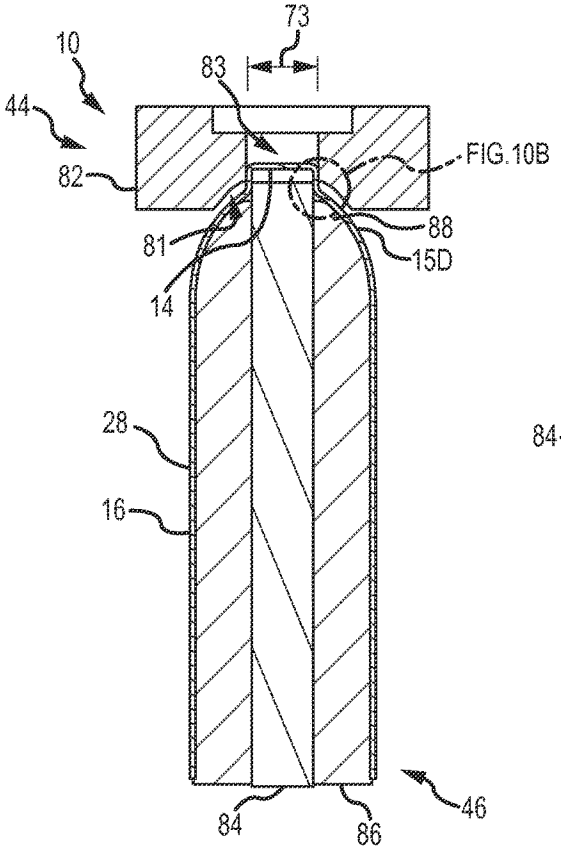
FIG. 10A is a longitudinal cross-sectional front elevation view of a first position of operation of tooling of the fourth drawing press as a fourth forming stroke begins according to one embodiment of the present invention.

Referring now to FIGS. 10A-10B, longitudinal cross-sectional front elevation views of a first position of operation of the tooling 44, 46 of the fourth drawing press 10 are illustrated as a fourth forming stroke begins according to one embodiment of the present invention. The upper tooling assembly 44 of the fourth drawing press 10 generally comprises a fourth draw die 82. The fourth draw die 82 includes a concave face portion 81 and a recess 83. The face portion 81 has a cross-sectional shape that is not linear. The recess 83 has a generally cylindrical shape with substantially linear walls. The interior diameter 73 of the recess 83 is substantially equal to the interior diameter 73 of the recess 69 of the third draw die 70. Accordingly, the fourth draw die 82 is adapted to reform the shoulder portion 15 of the metallic container without changing the diameter of the neck portion 13. The lower tooling assembly 46 generally comprises a form post or pilot 84 and a second clamping ring 86. The pilot 84 is similar to a form punch but, as will be appreciated by one of skill in the art, the pilot does not contact the interior surface 87 of the container endwall 14. The second clamping ring 86 has a convex face portion 88 with a cross-sectional shape that is not linear. The fourth draw die 82, pilot 84, and second clamping ring 86 are arranged substantially coaxially.

In operation, the metallic container body 28 is removed from the third draw press 8, received by the fourth drawing press 10, and positioned on the second clamping ring 86 and the pilot 84. The face portion 81 of the fourth draw die 82 is positioned proximate to the closed endwall 14 of the metallic container body 28.

Figure 11C:
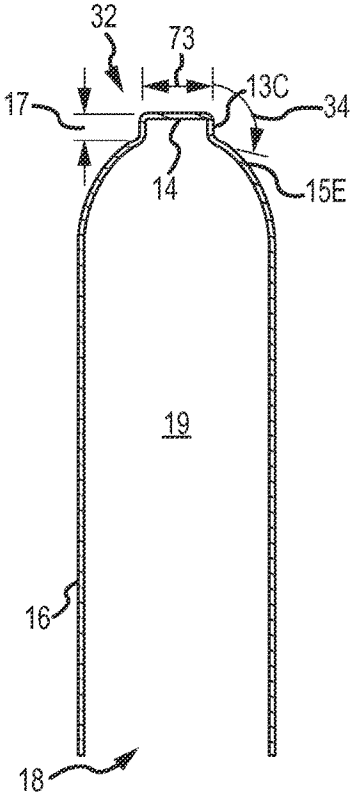
FIG. 11C is a longitudinal cross-sectional front elevation view of a metallic container body after the fourth forming stroke of the fourth drawing press is completed according to one embodiment of the present invention.
Figure 11B:
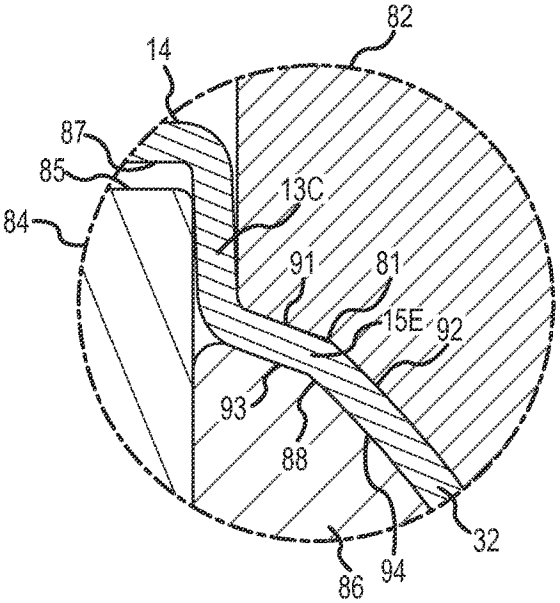
FIG. 11B is a detailed cross-sectional front elevation view of a portion of FIG. 11A.
Figure 11A:
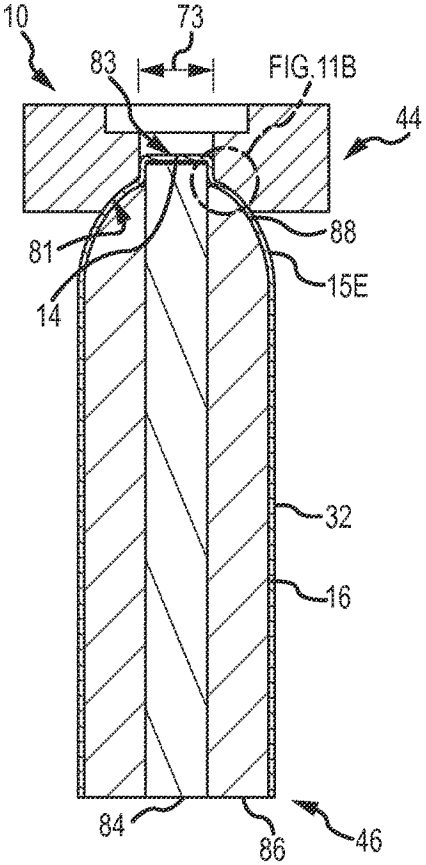
FIG. 11A is a longitudinal cross-sectional front elevation view of a second position of operation of tooling of the fourth drawing press as the fourth forming stroke is completed according to one embodiment of the present invention.

Referring now to FIGS. 11A-11B, the fourth draw die 82 and the second clamping ring 86 clamp on opposing surface portions of the metallic container body 28. The fourth draw die 82 and second clamping ring 86 alter the angle 34 between the neck portion 13C and the shoulder portion 15E compared to the angle 30 between the neck portion 13C and the shoulder portion 15D of the container body 28 received from the third drawing press, as illustrated in FIGS. 10A-10B. The pilot 84 guides and locates the neck portion 13C, serving as a backstop for the operation performed by the fourth draw die 82. The radius 30 of curvature between the neck portion 13C and the shoulder portion 15D of the metallic container body 28 is decreased. In one embodiment, the angle is made less obtuse and more acute. At no point is the shoulder portion 15D pushed and/or extended. The pilot 84 is operable to hold the sidewalls of the neck portion 13C of the metallic container body 28. In one embodiment, an end portion 85 of the pilot 84 does not come into contact with the inner surface portion 87 of the closed endwall 14 of the metallic container body 28. Consequently, the pilot 84 does not forcibly push the neck portion 13C. In another embodiment, the pilot 84 does not do any drawing work to the metallic container body. Thus, the fourth drawing press 10 functions to change the angle 34 where the neck portion 13C and shoulder 15E of the metallic container body 28 connect. The fourth drawing press 10 does not use a die and pusher to reform or pinch the shoulder portion 15E in its entirety and does not push or extend the shoulder 15E. In one embodiment, the pilot end portion 85 comprises a substantially planar surface orientated in a plane generally perpendicular to the body of the pilot 84.

In one embodiment of the present invention, during the fourth forming operation performed by the fourth press 10, only a selected portion of the shoulder 15 of the container body is reformed. Thus, the shoulder is not reformed in its entirety. In another embodiment, the selected portion of the shoulder 15 that is reformed is a radially innermost portion proximate to the neck portion 13. In still another embodiment, the selected portion of the shoulder 15 that is reformed comprises less than one-half of the length of the shoulder. Optionally, in another embodiment of the present invention, the tooling 44, 46 of the fourth drawing press 10 is adapted to reshape a portion of the shoulder portion 15 of the container body without increasing the height 17 or changing the diameter 73 of the neck portion 13. In still another embodiment of the present invention, substantially all of the interior surface portion of the shoulder portion 15 of the container body is in contact with the second clamping ring 86 during at least a portion of the fourth forming operation. In one embodiment, the neck height may optionally decrease by up to approximately 0.02 inches. In another embodiment, the neck height decreases by up to approximately 0.01 inches during the fourth forming operation.

In one embodiment, the maximum internal diameter of a concave face portion 81 of the fourth draw die 82 is less than the maximum external diameter of the shoulder portion 15. Said another way, a cross sectional length of the draw die face portion 81 is less than a cross-sectional length of the shoulder portion. In one embodiment, the length of the draw die face portion 81 is at least about ten percent less than the length of the shoulder portion 15. In another embodiment, the draw die face portion 81 has a maximum internal diameter that is less than the maximum external diameter of the face portion 88 of the second clamping ring 86.

In yet another embodiment, the second clamping ring 86 is adapted to contact substantially all of the interior surface portion of the container shoulder 15. Further, in another embodiment, cross-sectional profiles of the concave face portion 81 of the fourth draw die and the convex face portion 88 of the second clamping ring have shapes that are different than the shape of the shoulder 15D of the container 28 after the third forming operation is completed, as illustrated in FIG. 10B. In one embodiment, the draw die face portion 81 has a cross-sectional profile that includes a first portion 91 and a second portion 92 with a different slope. In another embodiment, the clamping ring face portion 88 has a first portion 93 and a second portion 94 that are substantially aligned with portions 91, 92, respectively.

Referring now to FIG. 11C, after the fourth drawing press 10 completes the fourth drawing operation, the metallic container body 32 has a predetermined radius 34 of curvature between the neck portion 13C and the shoulder portion 15E. The radius 34 is less than the radius 30 of container body 28. In one embodiment of the present invention, the radius of curvature 34 is between about 0.015 inches and about 0.06 inches. In a more preferred embodiment, the radius of curvature 34 is between about 0.02 inches and about 0.04 inches.

In one embodiment, when the metallic container body 32 leaves the fourth drawing press 10, as illustrated in FIG. 11C, the metallic container body has a height of between about 5 inches and about 11 inches. In another embodiment, the height of the metallic container body 32 is between about 8.768 inches and about 8.968 inches after the fourth operation. In still another embodiment, the height of the metallic container body 32 is between about 8.768 inches and about 8.968 inches after the fourth operation. Although various dimensions have been provided to describe the height and diameter of the metallic container bodies 12, 20, 24, 28, and 32, it is expressly contemplated that diameter and height of the metallic container bodies may be varied and still comport with the scope and spirit of the present invention.

Figure 12:
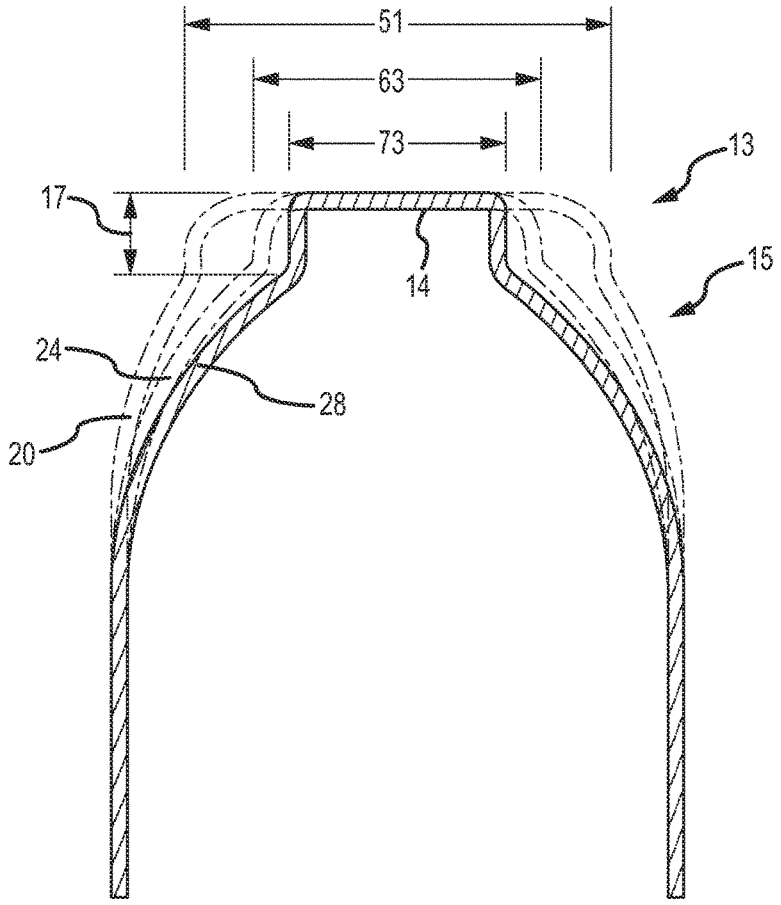
FIG. 12 shows partial cross-sectional front elevation views of the metallic container body of FIGS. 4B and 6B, in phantom lines, after the first and second forming strokes are completed and superimposed over a partial cross-sectional front elevation view of the metallic container body of FIG. 9B, in solid lines, after the third forming stroke is completed, illustrating changes in the shape of the shoulder portion and the diameter of the neck portion as the second and third forming strokes are performed.

Referring now to FIG. 12, partial views of the metallic container after the first, second, and third forming operations are completed are superimposed. More specifically, container bodies 20, 24 after the first and second forming operations performed by the first and second presses 4, 6 are shown in broken lines superimposed over a container body 28 after the third forming operation performed by the third press 8. The diameter 51, 63, 73 of the neck portion 13 decreases as the shoulder portion 15 is reshaped. The neck height 17 remains substantially constant during the forming operations performed by forming presses 4, 6, 8. However, one of skill in the art will appreciate that the tools of presses 4, 6, 8 may be adapted to alter the neck height 17 during one or more of the first, second, and third forming operations. Accordingly, in one embodiment of the present invention, the neck height increases in at least one forming operation performed by one of the presses 4, 6, 8. In another embodiment, the neck height decreases in at least one forming operation performed by one of the presses 4, 6, 8.

Figure 13:
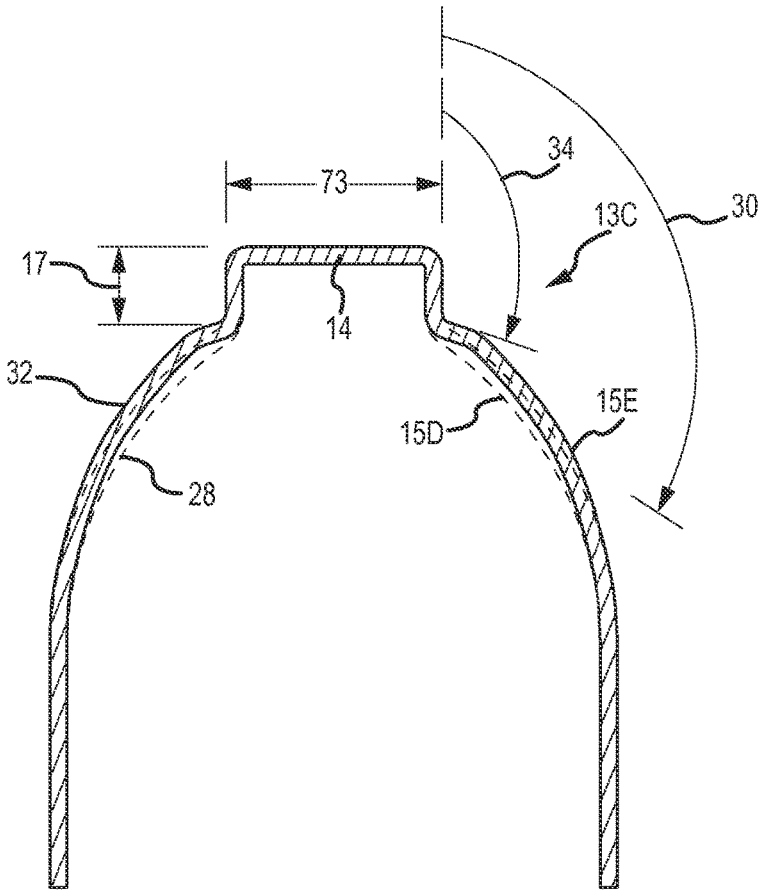
FIG. 13 is a partial cross-sectional front elevation view of the metallic container body of FIG. 9B, illustrated after the third forming stroke is completed in a phantom lines, superimposed over a partial cross-sectional front elevation view of the metallic container body of FIG. 11C, illustrated after the fourth forming stroke is completed in solid lines, and illustrating a reduction of the radius between the neck portion and shoulder portion as the diameter of the neck portion remains substantially constant.

Referring now to FIG. 13, a partial view of a container body 28 after the third forming operation is completed by the third press 8 is superimposed in broken lines over a container body 32 after the fourth press 10 completes the fourth forming operation. As previously described, the fourth press 10 is adapted to reform only a predetermined portion of the shoulder 15E. FIG. 13 also illustrates the change in the radius 30 of container body 28 compared to radius 34 of container body 32 according to one embodiment of the present invention. As shown, in one embodiment of the present invention, the radius 34 is less than radius 30. In one embodiment of the present invention, the neck height 17 and neck diameter 73 remain substantially unchanged during the fourth forming operation performed by the fourth press 10. In another embodiment, the fourth press 10 is operable to alter one or more of the neck height 17 and diameter 73. In still another embodiment, the neck height does not increase during the fourth forming operation. In another embodiment, the neck height may optionally decrease by up to about 0.02 inches. In a more preferred embodiment, the neck height decreases by up to about 0.01 inches.

Figure 14A:
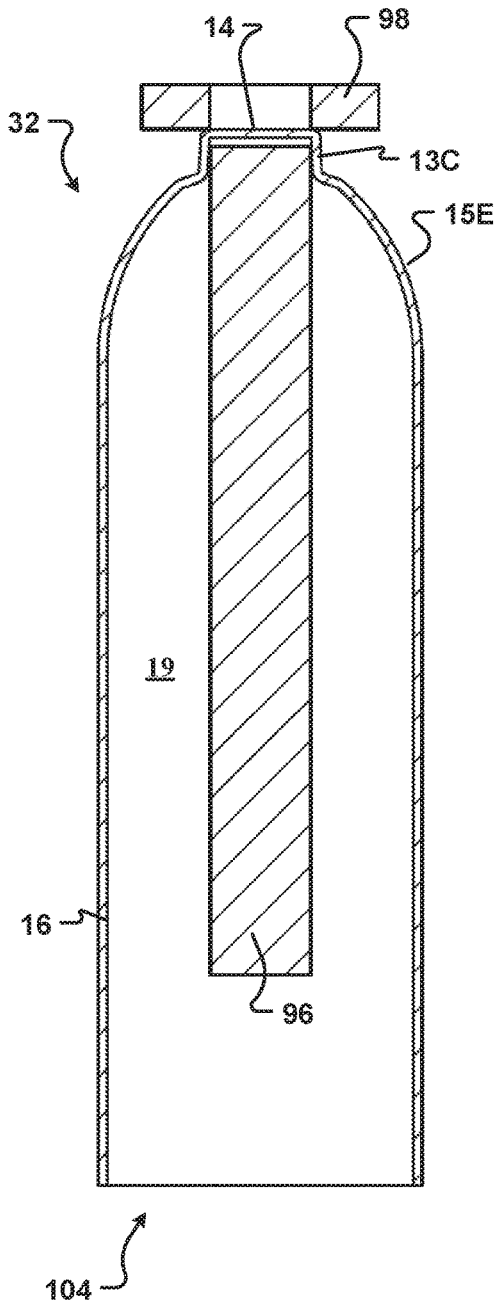
FIGS. 14A and 14B are longitudinal cross-sectional front elevation views illustrating tooling forming an opening on a metallic container body according to one embodiment of the present invention.
Figure 14B:
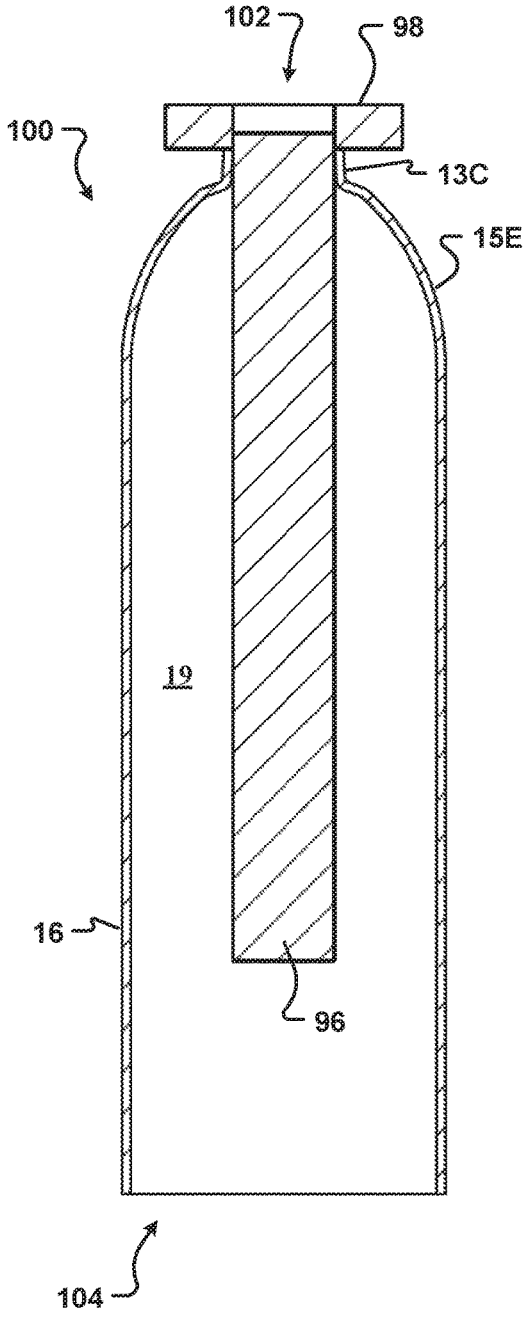

After the contoured shoulder 15E is formed, a number of subsequent operations transform the metallic container body 32 into a finished container. In one embodiment of the present invention, the subsequent operations may include one or more of dome trimming, die curling, and die necking to transform the metallic container body 32 into a two-piece container. As generally illustrated in FIGS. 14A, 14B, a top portion of the neck portion 13C is trimmed off by a punch 96 and die 98 forming a metallic container body 100 with a small top opening 102 and a larger bottom opening 104. The top opening is subsequently die-curled to receive an aerosol end closure dispenser. The bottom opening of the metallic container body is die-necked to a predetermined size. A closure with a dome is then double-seamed onto the bottom opening. The double-seamed dome portion on the bottom of the metallic container has a diameter no greater than the diameter of the sidewall of the metallic container to retain shelf space and increase packing density for shipping. By forming a contoured shoulder 15E on the closed endwall 14 of the metallic container body that becomes the top dispensing portion, the diameter of the aerosol end closure dispenser required to seal the top opening of the metallic container body is reduced, significantly decreasing the amount of material used in the aerosol end closure dispenser. The aerosol container may be inspected and air tested for quality of metal forming, hermetic integrity, and decoration quality. The aerosol container bodies are then stacked, palletized, and stored until needed. Subsequently, the aerosol container bodies are filled with a product and an aerosol end closure is seamed on to the top opening.

The description of the present invention has been presented for purposes of illustration and description, but is not intended to be exhaustive or limiting of the invention to the form disclosed. Many modifications and variations will be apparent to those of ordinary skill in the art. The embodiments described and shown in the figures were chosen and described in order to best explain the principles of the invention, the practical application, and to enable those of ordinary skill in the art to understand the invention.

While various embodiments of the present invention have been described in detail, it is apparent that modifications and alterations of those embodiments will occur to those skilled in the art. Moreover, references made herein to "the present invention" or aspects thereof should be understood to mean certain embodiments of the present invention and should not necessarily be construed as limiting all embodiments to a particular description. It is to be expressly understood that such modifications and alterations are within the scope and spirit of the present invention, as set forth in the following claims.

What is claimed is:

1. A method for simultaneously forming a contoured shoulder and neck portion on a closed end of a metallic container body having a first shape, comprising:

providing a draw die having an arcuate face portion adapted to be positioned proximate to an exterior of the closed end of the metallic container body;

providing a draw ring adapted to be positioned within an interior of the metallic container body and having an arcuate shaped face positioned in opposing relationship to said arcuate face portion of said draw die;

providing a second draw die having an arcuate face portion adapted to be positioned proximate to an exterior of a portion of a shoulder portion of the metallic container body;

providing a punch adapted to be positioned within an innermost portion of the metallic container body;

performing at least one forming operation with said punch, said draw die, and said draw ring on the closed end of the metallic container body to progressively form an arcuate shaped shoulder portion and the neck portion with a reduced diameter on the closed end of the metallic container body; and performing a final forming operation to change a radius between the arcuate shaped shoulder portion and the neck portion of the metallic container body, wherein a pilot supports an interior surface of the neck portion without contacting an interior surface of the closed end of the metallic container body while a clamping ring and said second draw die work in an opposing relationship to pinch the radius between the arcuate shaped shoulder portion and the neck portion to form the contoured shoulder, and wherein said arcuate face portion of said second draw die has a maximum internal diameter that is less than a maximum exterior diameter of an outer face of said clamping ring.

2. The method of claim 1, wherein during the final forming operation said second draw die contacts less than approximately 90% of the arcuate shaped shoulder portion such that a selected portion of the arcuate shaped shoulder portion is reshaped during the final forming operation.

3. The method of claim 2, wherein the selected portion of the arcuate shaped shoulder portion that is reshaped during the final forming operation is closer to the neck portion than to a sidewall portion of the metallic container body.

4. The method of claim 1, wherein the reduced diameter of the neck portion is not altered during the final forming operation.

5. The method of claim 1, wherein a height of the neck portion does not increase during the final forming operation.

6. The method of claim 1, wherein the maximum internal diameter of said arcuate face portion of said second draw die is less than a maximum exterior diameter of the arcuate shaped shoulder portion of the metallic container body.

7. The method of claim 1, further comprising:

providing one or more additional draw dies, draw rings, and punches; and performing additional forming operations by a complimentary movement between the one or more additional draw dies, additional draw rings, and additional punches to shape the geometry of the arcuate shaped shoulder portion and reduce a first diameter of the neck portion to a final diameter, wherein the final diameter of the neck portion is smaller than the first diameter.

8. The method of claim 7, wherein the additional forming operations comprise a second forming operation and a third forming operation, wherein the second forming operation is performed by a third draw die, a second draw ring, and a second punch to reduce the first diameter of the neck portion to a second diameter, and wherein the third forming operation is performed by a fourth draw die, a third draw ring, and a third punch to reduce the second diameter of the neck portion to the final diameter.

9. A method of simultaneously forming a contoured shoulder and a reduced diameter neck on a closed end portion of a metallic container, comprising:

providing the metallic container comprising an open end, the closed end portion, and a sidewall portion extending therebetween;

providing a punch;

providing a draw ring positioned adjacent to the punch and having an arcuate shaped leading end;

providing a draw die positioned on an exterior surface of the closed end portion and having an arcuate shaped draw die face and an upper recess with a predetermined diameter which is smaller than a diameter of the closed end portion of the metallic container;

engaging interior and exterior surfaces of the sidewall portion and the closed end portion of the metallic container with the draw ring and the draw die to provide a clamping force to simultaneously form the reduced diameter neck on the closed end portion and to change a shape of the contoured shoulder of the metallic container;

applying a force by the punch on the interior surface of the closed end portion when the draw ring and the draw die provide the clamping force:

repeating, at least one more time, the engaging with the draw ring and the draw die to modify the contoured shoulder of the metallic container while simultaneously reducing the diameter of the closed end portion at least one more time until the reduced diameter neck has a final external diameter; and reducing a radius interconnecting the reduced diameter neck and the contoured shoulder of the metallic container with a second draw die and a clamping ring to reshape a transition between the reduced diameter neck and the contoured shoulder of the metallic container, wherein a draw die face of the second draw die has a maximum internal diameter that is less than a maximum exterior diameter of a face of the clamping ring.

10. The method of claim 9, further comprising utilizing a draw die with a different arcuate shaped draw die face and upper recess and a different draw ring to modify the contoured shoulder of the metallic container while simultaneously reducing the diameter of the closed end portion.

11. The method of claim 9, wherein reducing the radius between the reduced diameter neck and the contoured shoulder does not increase a height of the reduced diameter neck.

12. The method of claim 9, wherein, while reducing the radius between the reduced diameter neck and the contoured shoulder, the interior surface of the closed end portion of the metallic container does not contact either a pilot or the clamping ring positioned within the interior of the metallic container.

13. The method of claim 9, wherein reducing the radius comprises:

engaging a predetermined portion of an exterior surface of the contoured shoulder with the draw die face of the second draw die;

engaging an interior surface of the contoured shoulder with the face of the clamping ring; and engaging an interior vertical surface of the reduced diameter neck with a pilot.

14. The method of claim 9, further comprising removing a portion of the reduced diameter neck to form an opening adapted to receive an end closure or a dispensing apparatus.

15. A set of tools for shaping a metallic container body with a closed end and a shoulder portion by working the closed end to simultaneously form a contoured, arcuate shoulder portion and a neck portion with a reduced diameter, comprising:

a draw die having an inner face with an arcuate shape adapted to be brought into abutment against an outer surface of the shoulder portion;

a draw ring having an outer face with an arcuate shape adapted to be brought into abutment against an inner surface of the shoulder portion, said draw ring outer face and said draw die inner face having opposing shapes to provide a compressive force on the shoulder portion;

a form punch for contacting and applying a force to an inner face of the closed end at a portion closer to a center of the closed end than the shoulder portion, said form punch having a predetermined diameter to form the neck portion in the closed end of the metallic container body;

a second draw die having a second inner face:

a pilot for supporting an inner vertical surface of the neck portion after the neck portion has been shaped to a predetermined diameter, wherein said pilot is positioned within an interior of the metallic container body after said draw ring and said form punch are withdrawn from the interior of the metallic container body: and a clamping ring positioned adjacent to said pilot within the interior of the metallic container body and having an outer face with an arcuate shape adapted to be brought into abutment against the inner surface of the shoulder portion, wherein said clamping ring supports the shoulder portion when a portion of the shoulder portion is pinched between said second inner face of said second draw die and said clamping ring outer face to change a radius of curvature between the shoulder portion and the neck portion, wherein said second inner face of said second draw die has a maximum diameter that is less than a maximum diameter of said outer face of said clamping ring.

16. The set of tools of claim 15, further comprising:

an exterior clamping ring having an inner face with an arcuate shape adapted to be brought into abutment against the outer surface of the shoulder portion, the exterior clamping ring positioned radially outward of said draw die; and an interior clamping ring to be positioned within the interior of the metallic container body with said draw ring and said form punch, said interior clamping ring having an outer face with an arcuate shape adapted to be brought into abutment against the inner surface of the shoulder portion, said interior clamping ring positioned radially outward of said draw ring and said form punch, wherein said exterior clamping ring and said interior clamping ring support the shoulder portion as said draw die, said draw ring, and said form punch change a diameter of the neck portion to the predetermined diameter.

17. The set of tools of claim 15, wherein a leading end portion of said inner face of said draw die has a shape that is not identical to a shape of the outer surface of the shoulder portion, and wherein a leading end portion of said outer face of said draw ring has a shape that is not identical to a shape of the inner surface of the shoulder portion.

18. The set of tools of claim 15, wherein said clamping ring and said second draw die modify an intersection of the neck portion and the shoulder portion without changing the predetermined diameter of the neck portion.

19. The set of tools of claim 18, wherein the radius of curvature between the shoulder portion and the neck portion is reduced and a height of the neck portion is not increased.

20. The set of tools of claim 18, wherein an axial end portion of said pilot does not come into contact with the inner face of the closed end of the metallic container body.

21. The set of tools of claim 15, wherein said maximum diameter of said second inner face of said second draw die is less than a maximum external diameter of the shoulder portion of the metallic container body such that said second draw die contacts less than approximately 90% of the shoulder portion.

* * * * *